US007281569B2

(12) United States Patent
Blejde et al.

(10) Patent No.: US 7,281,569 B2
(45) **Date of Patent: *Oct. 16, 2007**

(54) CASTING STEEL STRIP WITH LOW SURFACE ROUGHNESS AND LOW POROSITY

(75) Inventors: Walter N. Blejde, Brownsburg, IN (US); Rama Mahapatra, Brighton-Le-Sands (AU); Lazar Strezov, Adamstown Heights (AU)

(73) Assignee: Nucor Corporation, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/761,947

(22) Filed: Jan. 21, 2004

(65) Prior Publication Data

US 2004/0177944 A1 Sep. 16, 2004

Related U.S. Application Data

(63) Continuation-in-part of application No. 10/350,777, filed on Jan. 24, 2003, now abandoned.

(51) Int. Cl.
*B22D 11/06* (2006.01)

(52) U.S. Cl. ..... 164/477; 164/480

(58) Field of Classification Search ..... 164/480, 164/477, 483

See application file for complete search history.

(56) References Cited

U.S. PATENT DOCUMENTS 4,073,643 A * 2/1978 Kumai et al. ..... 75/508
4,152,140 A 5/1979 Hori et al.
4,235,632 A 11/1980 Uher et al.
4,250,950 A 2/1981 Buxmann et al.
4,368,084 A 1/1983 Irie et al.
4,746,361 A 5/1988 Pielet et al.
5,227,251 A 7/1993 Suichi et al.

(Continued)

FOREIGN PATENT DOCUMENTS

EP 0 800 881 A2 10/1997

(Continued)

OTHER PUBLICATIONS

Blejde, W. et al., "Recent Developments in Project M the Joint Development of Low Carbon Steel Strip Casting by BHP and IHI", METEC Congress 99, Dusseldorf, Germany, Jun. 13-15, 1999.
International Search Report for PCT/AU2004/000085.

*Primary Examiner*—Len Tran
(74) *Attorney, Agent, or Firm*—Hahn Loeser & Parks LLP; Arland T. Stein

(57) ABSTRACT

A method of producing cast steel strip having low surface roughness and low porosity by casting with molten steel having a total oxygen content of at least about 70 ppm and a free oxygen content between 20 and 60 ppm, and a temperature that allows a majority of any oxide inclusions to be in a liquidus state. The total oxygen content may be at least 100 ppm and the free oxygen content between 30 and 50 ppm. The steel strip produced by the method may have a per unit area density of at least about 120 oxide inclusions per square millimeter to a depth of about 2 microns from the strip surface.

13 Claims, 30 Drawing Sheets

U.S. PATENT DOCUMENTS

| | | | | |
|---|---|---|---|---|
| 5,520,243 | A | 5/1996 | Freeman et al. | |
| 5,535,812 | A | 7/1996 | Singleton | |
| 5,588,479 | A | 12/1996 | Leadbeatter et al. | |
| 5,701,948 | A | 12/1997 | Strezov et al. | |
| 5,720,336 | A | 2/1998 | Strezov | |
| 5,934,359 | A | 8/1999 | Strezov | |
| 6,059,014 | A | 5/2000 | Strezov | |
| 6,073,679 | A | 6/2000 | Strezov | |
| 6,120,621 | A | 9/2000 | Jin et al. | |
| 6,491,089 | B1 | 12/2002 | Poirier et al. | |
| 6,558,486 | B1 | 5/2003 | Strezov et al. | |
| 2003/0000679 | A1* | 1/2003 | Strezov | |
| 2003/0111206 | A1* | 6/2003 | Blejde et al. | 164/480 |

FOREIGN PATENT DOCUMENTS

| | | | |
|---|---|---|---|
| FR | 1 364 717 | | 5/1964 |
| JP | 51-67227 | A | 6/1976 |
| JP | 3-128149 | A | 5/1991 |
| JP | 4-41052 | A | 2/1992 |
| JP | 6-594 | A | 1/1994 |
| JP | 6-40650 | A | 2/1994 |
| JP | 6-134553 | A | 5/1994 |
| JP | 8-294751 | A | 11/1996 |
| JP | 2000-178634 | A | 6/2000 |
| JP | 2003-326342 | A | 11/2003 |
| WO | 95/13889 | A1 | 5/1995 |
| WO | 98/55251 | A1 | 12/1998 |
| WO | WO 00/07753 | | 2/2000 |
| WO | WO 03/024644 | A1 | 3/2003 |

* cited by examiner

SURFACE NUCLEATION, Ridge Textures: 180x20 and 180x60, (0.06 C, 0.01 S)
(After several no cleaning steps)

180x20 ridges

180x60 ridges

MAGNIFICATION X100

SURFACE NUCLEATION, PYRAMID AND GRIT BLAST SUBSTRATES, (0.06 C, 0.01 S)
(After several no cleaning steps)

Pyramid (160x20)

Grit Blast (Ra = 10)

MAGNIFICATION X100

CASTING STEEL STRIP WITH LOW SURFACE ROUGHNESS AND LOW POROSITY

RELATED APPLICATION

This application is a continuation-in-part of application Ser. No. 10/350,777, filed Jan. 24, 2003 now abandoned.

BACKGROUND AND SUMMARY

This invention relates to the casting of steel strip in a twin roll caster.

In a twin roll caster molten metal is introduced between a pair of counter-rotated horizontal casting rolls, which are cooled so that metal shells solidify on the moving roll surfaces and are brought together at the nip between them to produce a solidified strip product delivered downwardly from the nip. The term "nip" is used herein to refer to the general region at which the rolls are closest together. The molten metal may be poured from a ladle into a smaller vessel from which it flows through a metal delivery nozzle located above the nip forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow.

When casting steel strip in a twin roll caster, the casting pool will generally be at a temperature in excess of 1550° C. And usually 1600° C. And greater. It is necessary to achieve very rapid cooling of the molten steel over the casting surfaces of the rolls in order to form solidified shells in the short period of exposure on the casting surfaces to the molten steel casting pool during each revolution of the casting rolls. Moreover, it is important to achieve even solidification so as to avoid distortion of the solidifying shells which come together at the nip to form the steel strip. Distortion of the shells can lead to surface defects known as "crocodile skin" surface roughness. Crocodile skin surface roughness is illustrated in FIG. 1, and involves periodic rises and falls in the strip surface of 40 to 80 microns, in periods of 5 to 10 millimeters, measured by profilometer. Even if pronounced surface distortions and defects are avoided, minor irregularities in shell growth and shell distortions will still lead to liquid entrapment in discrete pockets, or voids, between the two shells in the middle portion of the steel strip. These voids are generated as the entrapped liquid solidifies, and cause a porosity in the steel strip observed by x-ray as shown in FIG. 2 herein and in FIG. 2*b* of our paper entitled "Recent Developments in Project M the Joint Development of Low Carbon Steel Strip Casting" by BHP and IHI, presented at the METEC Congress 99, Dusseldorf Germany (Jun. 13-15, 1999). This necessitates in-line hot rolling of the strip to eliminate the porosity since the strip cannot otherwise be used even as feed for cold rolling because of cracks generated by the voids and potential breakage of the strip under tension.

It has hitherto been thought that such internal porosity was inevitable in as-cast thin cast strip, which needed to be eliminated by in-line hot rolling. However, after carefully considering the factors which may lead to uneven solidification and extensive experience in casting steel strip in a twin roll caster with control over those various factors, we have determined that it is possible to achieve more even shell growth to avoid crocodile skin surface roughness, and also, avoid significant liquid entrapment and thus substantially reduce porosity.

According to the present invention, there is provided a method of producing thin cast strip with low surface roughness and low porosity comprising the steps of:

assembling a pair of cooled casting rolls having a nip between them and with confining closure adjacent the ends of nip;

introducing molten steel having a total oxygen content of at least 70 ppm, usually below 250 ppm, and free oxygen content between 20 and 60 ppm, between the pair of casting rolls to form a casting pool at a temperature such that the majority of oxide inclusions formed therein are in liquid state;

counter-rotating the casting rolls and transferring heat from the molten steel to form solidified shells on the surfaces of the casting rolls such that the shells grow to include oxide inclusions relating to the total oxygen and free oxygen content of the molten steel and form steel strip free of crocodile surface roughness; and forming solidified thin steel strip through the nip between the casting rolls from said solidified shells.

According to the present invention, there is also provided a method of producing thin cast strip with low surface roughness and low porosity comprising the steps of:

assembling a pair of cooled casting rolls having a nip between them and with confining closure adjacent the ends of nip;

introducing molten steel having a total oxygen content of at least 100 ppm, usually below 250 ppm, and free oxygen content between 30 and 50 ppm, between the pair of casting rolls to form a casting pool at a temperature such that the majority of oxide inclusions formed therein are in liquid state;

counter-rotating the casting rolls and transferring heat from the molten steel to form solidified shells on the surfaces of the casting rolls such that the shells grow to include oxide inclusions relating to the total oxygen and free oxygen content of the molten steel and form steel strip free of crocodile surface roughness; and forming solidified thin steel strip through the nip between the casting rolls from said solidified shells.

Although also useful in making stainless steel, the method has been found particularly useful in making low carbon steel. In any case, the steel shells may have manganese oxide, silicon oxide and aluminum oxide inclusions so as to produce steel strip having a per unit area density of at least 120 oxide inclusions per square millimeter to a depth of 2 microns from the strip surface. The melting point of the inclusions may be below 1600° C., and preferably is about 1580° C., and below the temperature of the metal in the casting pool. Oxide inclusions comprised of MnO, $SiO_2$ and $Al_2O_3$ may be distributed through the molten steel in the casting pool with an inclusion density of between 2 and 4 grams per cubic centimeter.

Without being limited by theory, avoidance of crocodile skin surface roughness and lower porosity is believed to be provided by controlling the rate of growth and the distribution of growth of the solidifying metal shells during casting. The primary factors in avoiding shell distortion have been found to be caused by a good distribution of solidification nucleation sites in the molten steel over the casting surfaces, and a controlled rate of shell growth particularly in the initial stages of solidification immediately following nucleation. Further, we have found that it is important that before the solidifying shells pass through the ferrite to austenite transformation, the shells reach sufficient thickness of greater than 0.30 millimeters to resist the stresses that are generated by the volumetric change that accompanies this transformation, and further that transformation from ferrite to austenite phase occur before the shells pass through the nip. This will generally be sufficient to resist the stresses that are generated by the volumetric change that accompanies the transformation. For example, with the heat flux on the order of 14.5 megawatts per square meter, the thickness of each shell may be about 0.32 millimeters at the start of the ferrite to austenite transformation, about 0.44 millimeters at the end of that transformation and about 0.78 millimeters at the nip.

We have also determined that crocodile skin roughness is avoided by having a nucleation per unit area density of at least 120 per square millimeter. We believe such crocodile skin roughness is also avoided by generating controlled heat flux of less than 25 megawatts per square meter during the initial 20 millisecond solidification in the upper or meniscus region of the casting pool to establish coherent solidified shells, and to ensure a controlled rate of the growth of those shells in a way which avoids shell distortion which might lead to liquid entrapment in the strip.

A good distribution of nucleation sites for initial solidification can be accomplished by employing casting surfaces with a texture formed by a random pattern of discrete projections. Said discrete projections of the casting surfaces may have an average height of at least 20 microns and they may have an average surface distribution of between 5 and 200 peaks per $mm^2$. In any event, the casting surface of each roll may be defined by a grit blasted substrate covered by a protective coating. More particularly, the protective coating may be an electroplated metal coating. Even more specifically, the substrate may be copper and the plated coating may be of chromium.

The molten steel in the casting pool may be a low carbon steel having carbon content in the range of 0.001% to 0.1% by weight, manganese content in the range of 0.01% to 2.0% by weight and silicon content in the range of 0.01% to 10% by weight. The molten steel may have aluminum content of the order of 0.01% or less by weight. The molten steel may have manganese, silicon and aluminum oxides producing in the steel strip $MnO.SiO_2.Al_2O_3$ inclusions in which the ratio of $MnO/SiO_2$ is in the range of 1.2 to 1.6 and the $Al_2O_3$ content of the inclusions is less than 40%. The inclusion may contain at least 3% $Al_2O_3$.

Part of the present invention is the production of a novel steel strip having improved surface roughness and porosity by following the method steps as described above. This composition of steel strip cannot, to our knowledge, be described other than by the process steps used in forming the steel strip as described above.

In order that the invention may be more fully explained, the results of extensive experience in casting low carbon steel strip in a twin roll caster will be described with reference to the accompanying drawings in which:

DETAILED DESCRIPTION OF THE DRAWINGS

Figure 1:
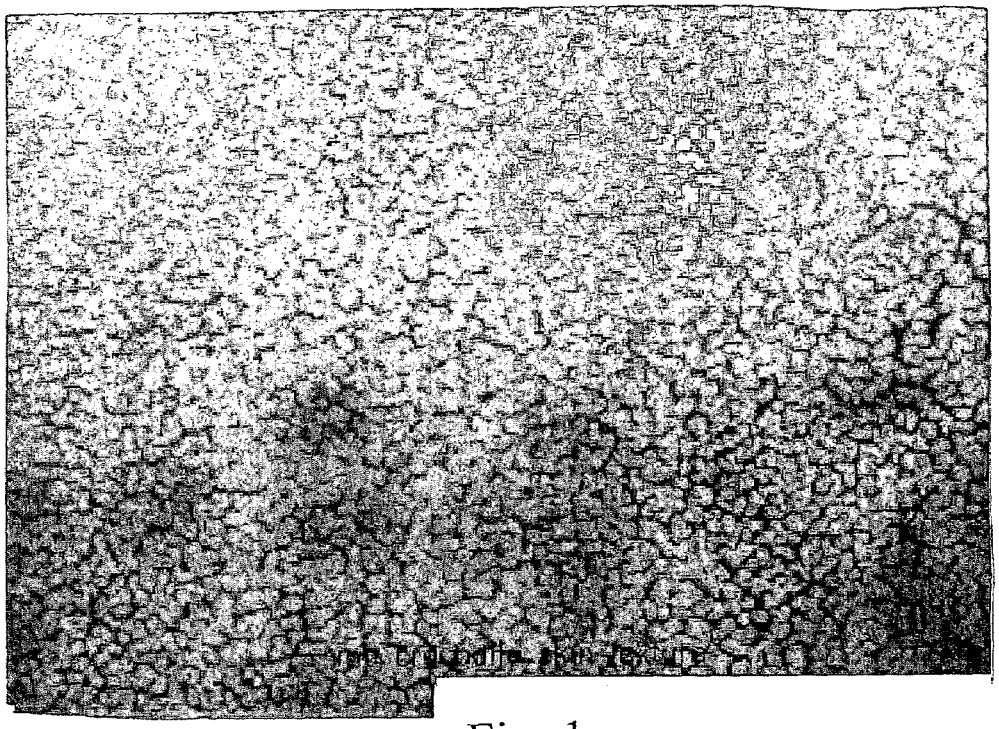
FIG. 1 is a photograph of crocodile skin surface roughness in prior art thin steel strip.
Figure 2:
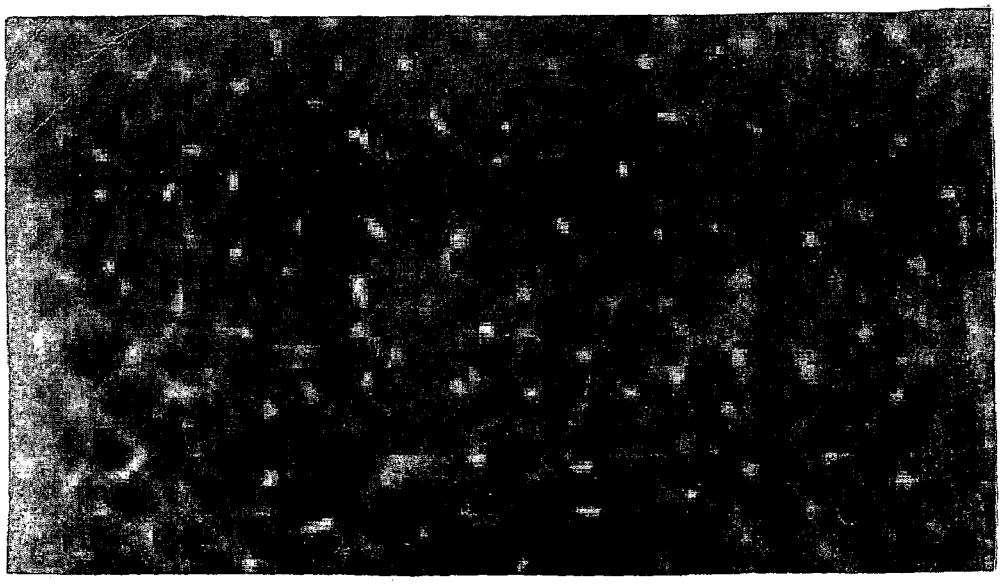
FIG. 2 is a photograph of an x-ray showing porosity in prior art thin steel strip.

For the purposes of promoting an understanding of the principles of the invention, reference will now be made to the embodiments illustrated in the drawings and specific language will be used to describe same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIGS. 3 to 7 illustrate a twin roll continuous strip caster which may be operated in accordance with the present invention. This caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a tundish 18 and delivery nozzle 19 to create a casting pool 30. Casting rolls 16 are water cooled so that shells solidify on the moving roll surfaces 16A and are brought together at the nip between them to produce a solidified strip product 20 at the roll outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Roll cradles 34 are mounted on the carriage frame 31 by inter-engaging complementary slide members 35, 36 to allow the cradles to be moved on the carriage under the influence of hydraulic cylinder units 37, 38 to adjust the width of the nip between die casting rolls 16 and to enable the rolls to be rapidly moved apart for a short time interval when it is required to form a transverse line of weakness across the strip as will be explained in more detail below. The carriage is movable as a whole along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are counter-rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm in diameter and up to 2000 mm long in order to produce 2000 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as magnesium oxide (MgO). One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roll carriage frame 31 and provided with apertures to receive indexing pegs 54 on the carriage frame so as to accurately locate the tundish.

Delivery nozzle 19 is formed as an elongate body made of a refractory material such as alumina graphite. Its lower part is tapered so as to converge inwardly and downwardly so that it can project into the nip between casting rolls 16. It is provided with a mounting bracket 60 to support it on the roll carriage frame and its upper part is formed with outwardly projecting side flanges 55 which locate on the mounting bracket.

Nozzle 19 may have a series of horizontally spaced generally vertically extending flow passages to produce a suitably low velocity discharge of metal throughout the width of the rolls and to deliver the molten metal into the nip between the rolls without direct impingement on the roll surfaces at which initial solidification occurs. Alternatively, the nozzle may have a single continuous slot outlet to deliver a low velocity curtain of molten metal directly into the nip between the rolls and/or it may be immersed in the molten metal pool.

The pool is confined at the ends of the rolls by a pair of side closure plates 56 which are held against stepped ends 57 of the rolls when the roll carriage is at the casting station. Side closure plates 56 are made of a strong refractory material, for example boron nitride, and have scalloped side edges 81 to match the curvature of the stepped ends 57 of the rolls. The side plates can be mounted in plate holders 82 which are movable at the casting station by actuation of a pair of hydraulic cylinder units 83 to bring the side plates into engagement with the stepped ends of the casting rolls to form end closures for the molten pool of metal formed on the casting rolls during a casting operation.

During a casting operation the ladle stopper rod 46 is actuated to allow molten metal to pour from the ladle to the tundish through the metal delivery nozzle whence it flows to the casting rolls. The clean head end of the strip product 20 is guided by actuation of an apron table 96 to the jaws of the coiler 21. Apron table 96 hangs from pivot mountings 97 on the main frame and can be swung toward the coiler by actuation of an hydraulic cylinder unit 98 after the clean head end has been formed. Table 96 may operate against an upper strip guide flap 99 actuated by a piston and a cylinder unit 101 and the strip product 20 may be confined between a pair of vertical side rollers 102. After the head end has been guided in to the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster.

Full particulars of a twin roll caster of the kind illustrated in FIGS. 3 to 7 are more fully described in our U.S. Pat. Nos. 5,184,668 and 5,277,243 and International Patent Application PCT/AU93/00593.

After extensive operation of a twin roll caster as described herein with reference to FIGS. 3 to 7, we have identified factors to be controlled in order to cast steel strip which is substantially free of crocodile skin surface roughness and of porosity in the as-cast condition. Such strip need not be subjected to in-line hot rolling to eliminate porosity and may be used in the as-cast condition or used as feed stock for cold rolling.

In general terms, the improvement of crocodile skin surface roughness and porosity can be achieved by careful control over initial nucleation and initial heat flux in the initial stages of solidification to ensure a controlled rate of shell growth. Initial nucleation may be controlled by ensuring a good distribution of nucleation sites by the provision of textured casting surfaces formed by a random pattern of discrete projections which, together with a steel chemistry of the molten steel feed of total oxygen content greater than 70 ppm, typically less than 250 ppm, and free oxygen content of between 20 and 60 ppm, produces a good distribution of oxide inclusions to serve as nucleation sites. The oxygen content of the molten steel feed may be at least 100 ppm total oxygen and between 30 and 50 ppm free oxygen.

For example, forming a textured surface on the casting surfaces of the casting rolls having a random pattern of discrete projections, having an average height of at least 20 microns and having an average surface distribution of between 5 and 200 peaks per square millimeters may produce the desired distribution of nucleation sites. The temperature of the molten casting pool is maintained at a temperature at which the majority of oxide inclusions are in liquid form during nucleation and the initial stages of solidification. We have also determined that the initial contact heat flux should be such that the transfer of heat from the molten metal to the casting surfaces during the initial 20 milliseconds of solidification is no more than 25 megawatts per square meter in order to prevent rapid shell growth and distortion. This control of shell growth also can be met by the use of the selected surface texture.

Figure 8:
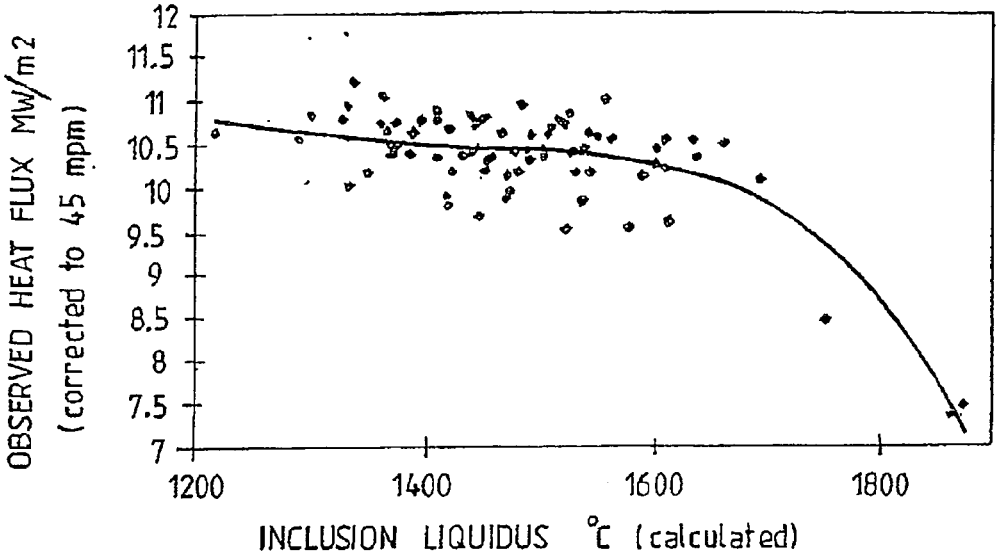
FIG. 8 shows the effect of inclusion melting points on heat fluxes obtained in twin roll casting trials using silicon/manganese killed steels.

Casting trials using silicon manganese killed low carbon steel have demonstrated that the melting point of oxide inclusions in the molten steel have an effect on the heat fluxes obtained during steel solidification as illustrated in FIG. 8. Low melting point oxides improve the heat transfer contact between the molten metal and the casting roll surfaces heat transfer rates. Liquid inclusions are not produced when their melting points are greater than the steel temperature in the casting pool. Therefore, there is a dramatic reduction in heat transfer rate when the inclusion melting point is greater than approximately 1600° C. The melting point of the inclusions in the casting pool should therefore be maintained at 1600° C. and below, and particularly beyond the temperature of molten steel in the casting pool.

The oxide inclusions formed in the solidified metal shells and in turn the thin steel strip contain solidification inclusions formed during solidification of the steel shells, and deoxidation inclusions formed during refining in the ladle. With casting trials, we found that with aluminum killed steels, the formation of high melting point alumina inclusions (melting point 2050° C.) could be limited if not avoided by calcium additions to the composition to provide liquid $CaO.Al_2O_3$ inclusions.

The free oxygen level in the steel is reduced dramatically during cooling at the meniscus, resulting in the generation of solidification inclusions near the surface of the strip. These solidification inclusions are formed predominantly of $MnO.SiO_2$ by the following reaction:

$$Mn+Si+3O=MnO.SiO_2.$$

Figure 3:
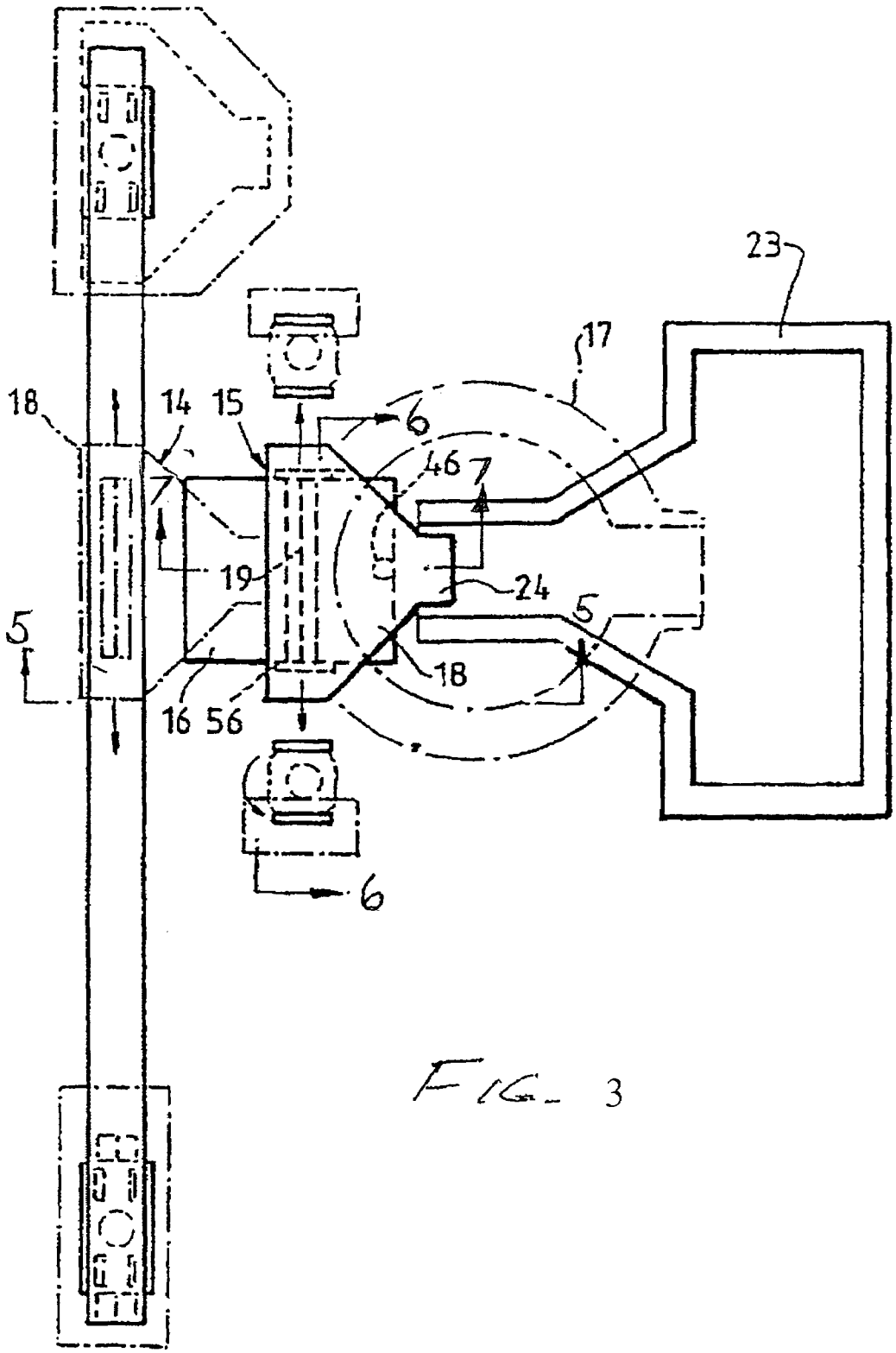
FIG. 3 is a plan view of a continuous strip caster which is operable in accordance with the invention.
Figure 4:
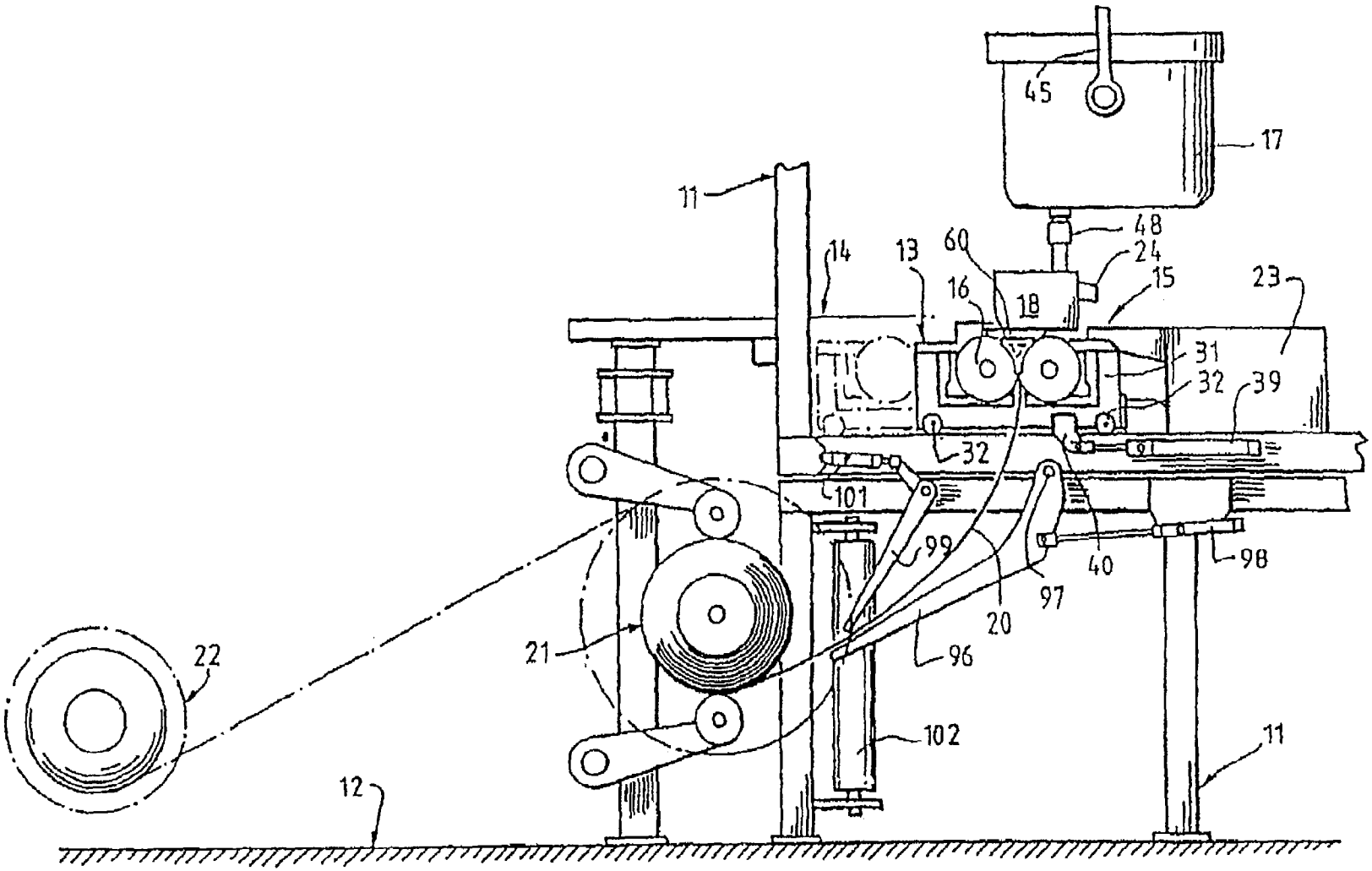
FIG. 4 is a side elevation of the strip caster shown in FIG. 3.
Figure 5:
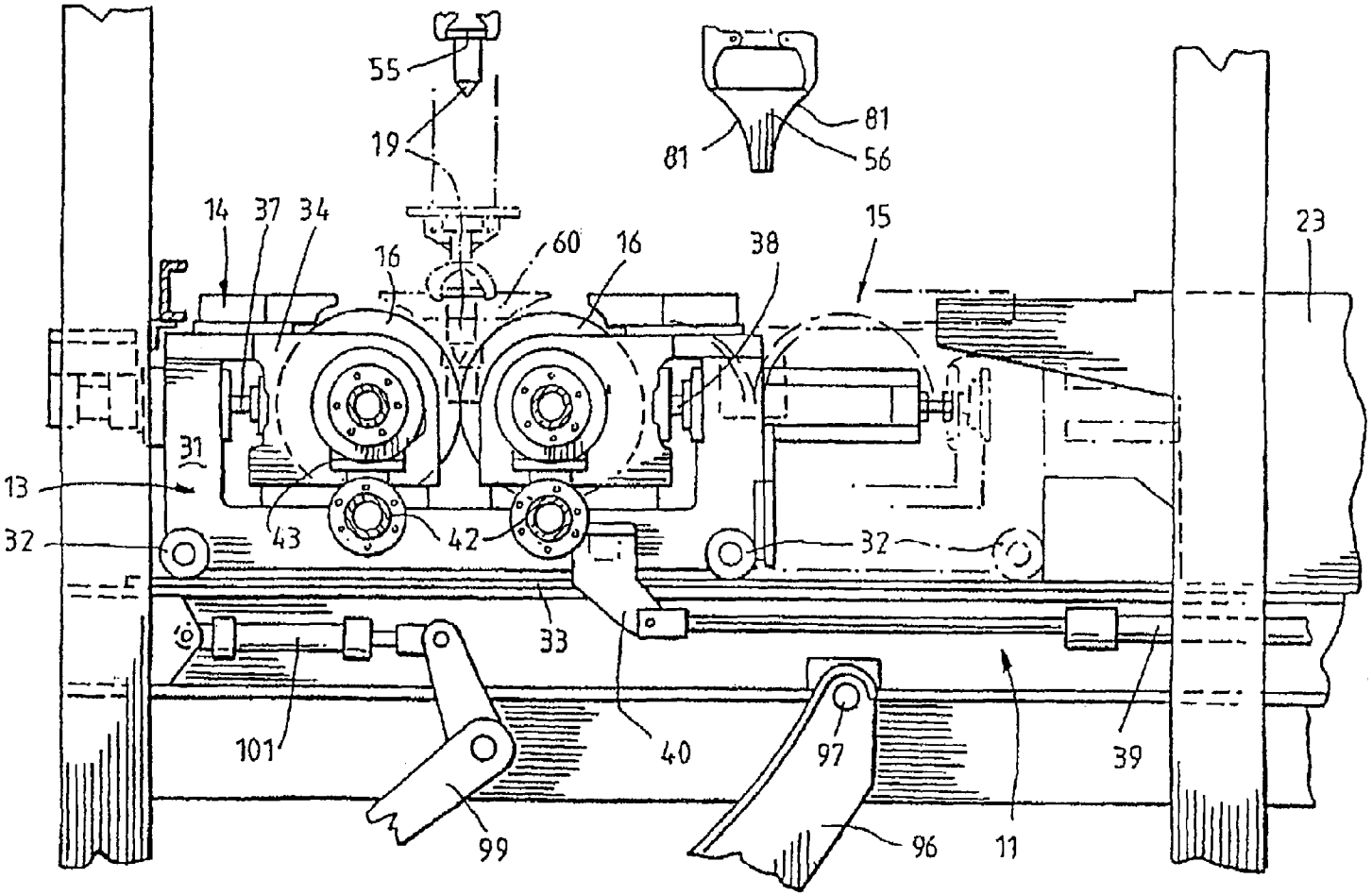
FIG. 5 is a vertical cross-section on the line 5-5 in FIG. 3.
Figure 6:
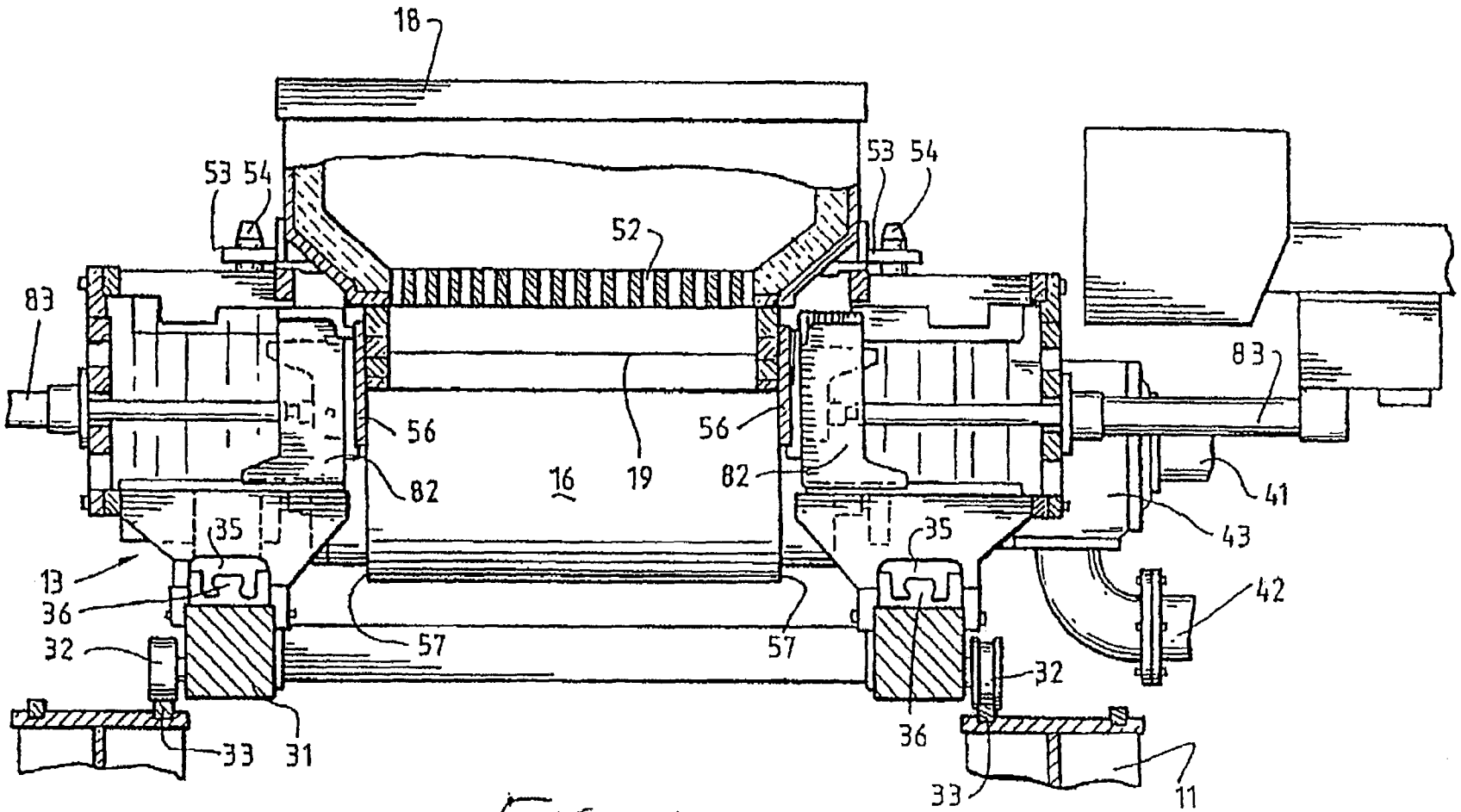
FIG. 6 is a vertical cross-section on the line 6-6 in FIG. 3.
Figure 7:
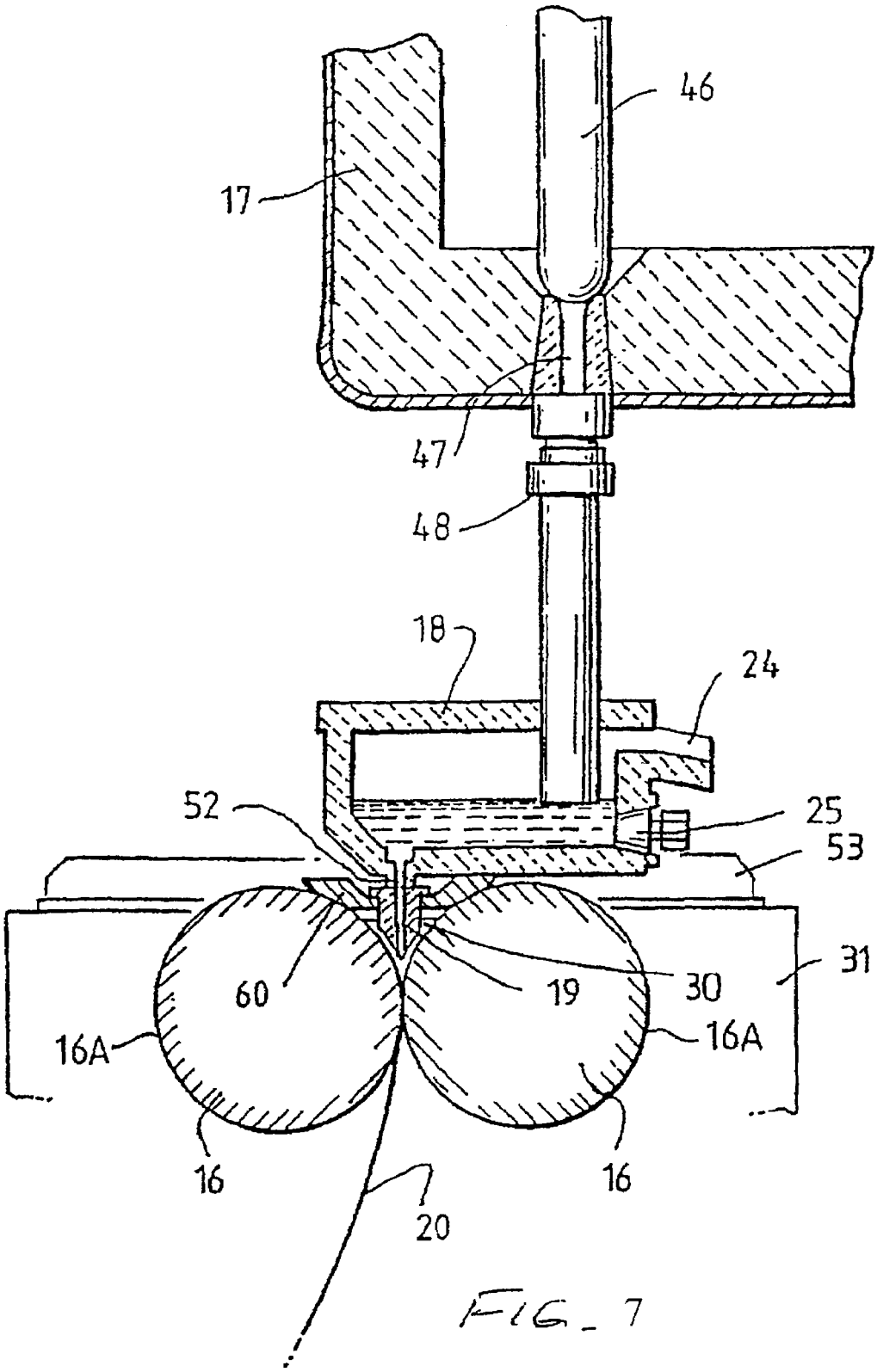
FIG. 7 is a vertical cross-section on the line 7-7 in FIG. 3.
Figure 9:
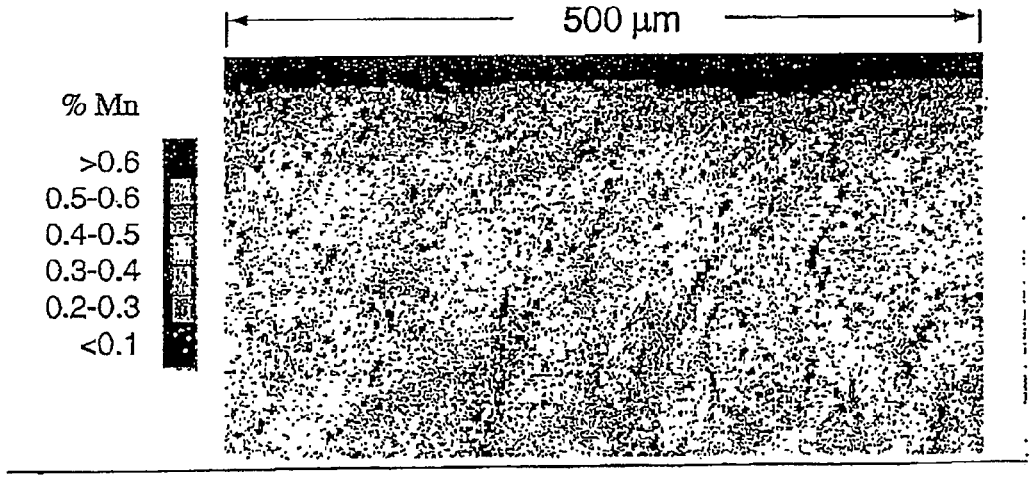
FIG. 9 is an energy dispersive spectroscopy (EDS) map of Mn showing a band of fine solidification inclusions in a solidified steel strip.

The appearance of the solidification inclusions on the strip surface, obtained from an Energy Dispersive Spectroscopy (EDS) map, is shown in FIG. 9. It can be seen that solidification inclusions are extremely fine (typically less than 2 to 3 μm) and are located in a band located within 10 to 20 μm from the surface. A typical size distribution of the oxide inclusions through the strip is shown in FIG. 3 of our paper entitled Recent Developments in Project M the Joint Development of Low Carbon Steel Strip Casting by BHP and IHI, presented at the METEC Congress 99, Dusseldorf Germany (Jun. 13-15, 1999), which may be consulted for more information.

Figure 10:
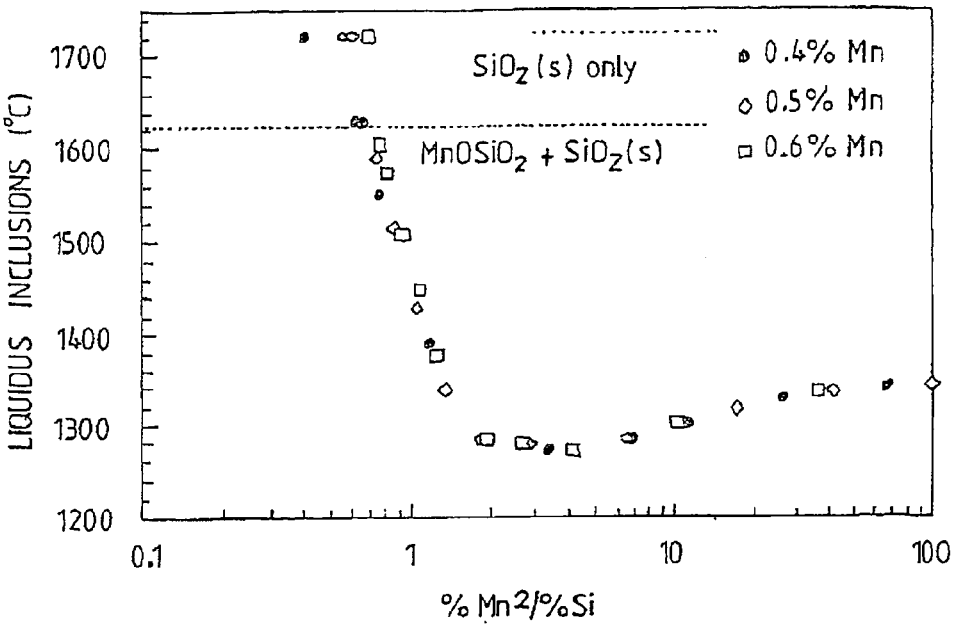
FIG. 10 is a plot showing the effect of varying manganese to silicon contents on the liquidus temperature of inclusions.

In silicon manganese killed steel, the comparative levels of the solidification inclusions are primarily determined by the Mn and Si levels in the steel. FIG. 10 shows that the ratio of Mn to Si has a significant effect on the liquidus temperature of the inclusions. A manganese silicon killed steel having a carbon content in the range of 0.001% to 0.1% by weight, a manganese content in the range 0.1% to 10% by weight, a silicon content in the range of 0.01% to 10% by weight, and an aluminum content of the order of 0.01% or less by weight can produce such solidification oxide inclusions during cooling of the steel in the upper regions of the casting pool. In particular, the steel may have the following composition, termed M06:

| | |
|---|---|
| Carbon | 0.06% by weight |
| Manganese | 0.6% by weight |
| Silicon | 0.28% by weight |
| Aluminum | 0.002% by weight |

Deoxidation inclusions are generally generated during deoxidation of the molten steel in the ladle with Al, Si and Mn. Thus, the composition of the oxide inclusions formed during deoxidation is mainly $MnO.SiO_2.Al_2O_3$ based. These deoxidation inclusions are randomly located in the strip and are coarser than the solidification inclusions near the strip surface formed by reaction of the free oxygen during casting.

Figure 11:
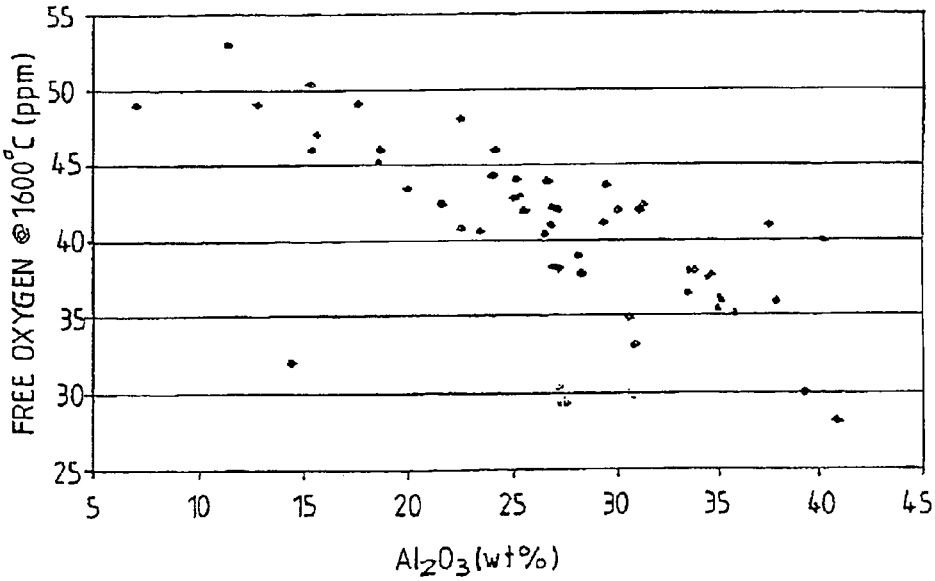
FIG. 11 shows the relationship between alumina content (measured from the strip inclusions) and deoxidation effectiveness.

The alumina content of the inclusions has a strong effect on the free oxygen level in the steel, and can be used to control the free oxygen levels in the melt. FIG. 11 shows that with increasing alumina content, free oxygen in the steel is reduced. The free oxygen reported in FIG. 4 was measured using the Celox® measurement system made by Heraeus Electro-Nite, and the measurements normalized to 1600° C. to standardized reported of the free oxygen content as in the claims that follow. With the introduction of alumina, $MnO.SiO_2$ inclusions are diluted with a subsequent reduction in their activity which in turn reduces the free oxygen level, as seen from the following reaction:

$$Mn+Si+3O+Al_2O_3 \Leftrightarrow (Al_2O_3).MnO.SiO_2$$

Figure 12:
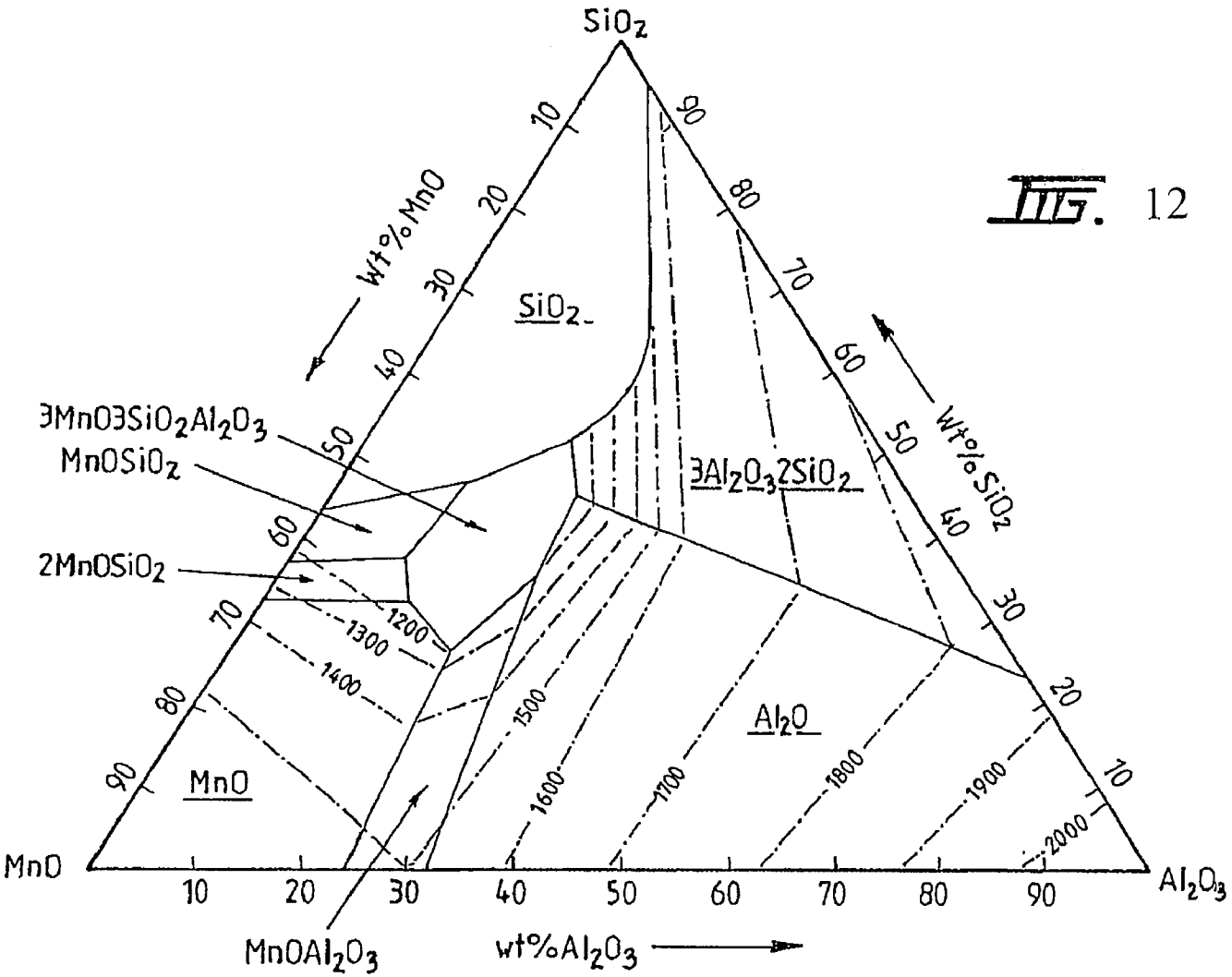
FIG. 12 is a ternary phase diagram for $MnO.SiO_2.Al_2O_3$.
Figure 13:
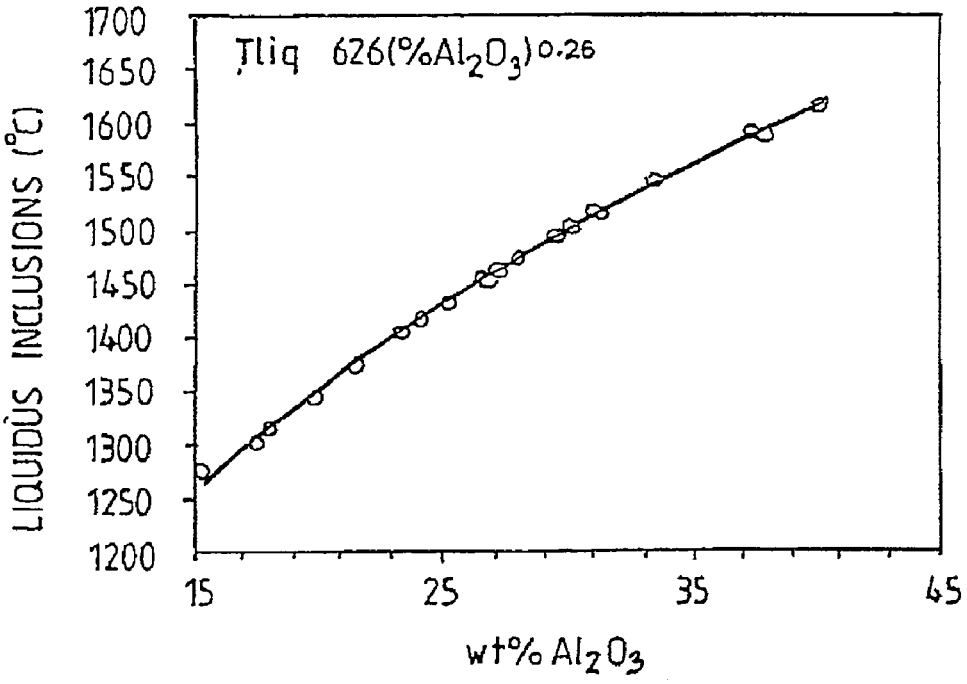
FIG. 13 shows the relationship between alumina content inclusions and liquidus temperature.

For $MnO—SiO_2—Al_2O_3$ based inclusions, the effect of inclusion composition on liquidus temperature can be obtained from the ternary phase diagram shown in FIG. 12. Analysis of the oxide inclusions in the thin steel strip has shown that the $MnO/SiO_2$ ratio is typically within 0.6 to 0.8 and for this regime, it was found that alumina content of the oxide inclusions had the strongest effect on the inclusion melting point (liquidus temperature) of the inclusions, as shown in FIG. 13.

We have determined that it is important for casting in accordance with the present invention to have sufficient solidification and deoxidation inclusions and be at a temperature such that a majority of the inclusions are in liquid state at the initial solidification temperature of the steel. The molten steel in the casting pool has a total oxygen content of at least 70 ppm and a free oxygen content between 20 and 60 ppm to produce metal shells with levels of oxide inclusions reflected by the total oxygen and free oxygen contents of the molten steel to promote nucleation during the initial solidification of the steel on the casting roll surfaces. Both solidification and deoxidation inclusions are oxide inclusions and provide nucleation sites and contribute significantly to nucleation during the metal solidification process, but the deoxidation inclusions may be rate controlling in that their concentration can be varied and their concentrations effect the concentration of the free oxygen present. The deoxidation inclusions are much bigger, typically greater than 4 microns, whereas the solidification inclusions are generally less than 2 microns and are $MnO.SiO_2$ based and have no $Al_2O_3$ whereas the deoxidation inclusions also have $Al_2O_3$ as part of the inclusions.

It has been found in casting trials using the above M06 grade of silicon/manganese killed low carbon steel that if the total oxygen content of the steel is reduced in the ladle refining process to low levels of less than 100 ppm, heat fluxes are reduced and casting is impaired whereas good casting results can be achieved if the total oxygen content is at least above 100 ppm and typically on the order of 200 ppm. As described in more detail below, these oxygen levels in the ladle result in total oxygen levels of at least 70 ppm and free oxygen levels between 20 and 60 ppm in the tundish, and in turn slightly lower oxygen levels in the casting pool. The total oxygen content may be measured by an "LECO" instrument and is controlled by the degree of "rinsing" during ladle treatment, i.e. the amount of argon bubbled through the ladle via a porous plug or top lance, and the duration of the treatment. The total oxygen content was measured by conventional procedures using the LECO TC-436 Nitrogen/Oxygen Determinator described in the TC 436 *Nitrogen/Oxygen Determinator Instructional Manual* available from LECO (Form No. 200-403, Rev. April 96, Section 7 at pp. 7-1 to 7-4).

In order to determine whether the enhanced heat fluxes obtained with higher total oxygen contents was due to the availability of oxide inclusions as nucleation sites during casting, casting trials were carried out with steels in which deoxidation in the ladle was carried out with calcium silicide (Ca—Si) and the results compared with casting with the low carbon Si-killed steel known as M06 grades of steel. The results are set out in the following table:

TABLE 1

Heat flux differences between M06 and Cal-Sil grades.

| Cast No. | Grade | Casting speed, (m/min) | Pool Height, (mm) | Total heat removed (MW) |
|---|---|---|---|---|
| M 33 | M06 | 64 | 171 | 3.55 |
| M 34 | M06 | 62 | 169 | 3.58 |
| O 50 | Ca—Si | 60 | 176 | 2.54 |
| O 51 | Ca—Si | 66 | 175 | 2.56 |

Although Mn and Si levels were similar to normal Si-killed grades, the free oxygen level in Ca—Si heats was lower when the oxide inclusions contained more CaO. This is shown in Table 2. Heat fluxes in Ca—Si heats were therefore lower despite a lower inclusion melting point.

TABLE 2

Slag compositions with Ca—Si deoxidation

| Grade | Free Oxygen (ppm) | Slag Composition (wt %) SiO2 | MnO | Al2O3 | CaO | Inclusion melting temperature (° C.) |
|---|---|---|---|---|---|---|
| Ca—Si | 23 | 32.5 | 9.8 | 32.1 | 22.1 | 1399 |

Figure 14:
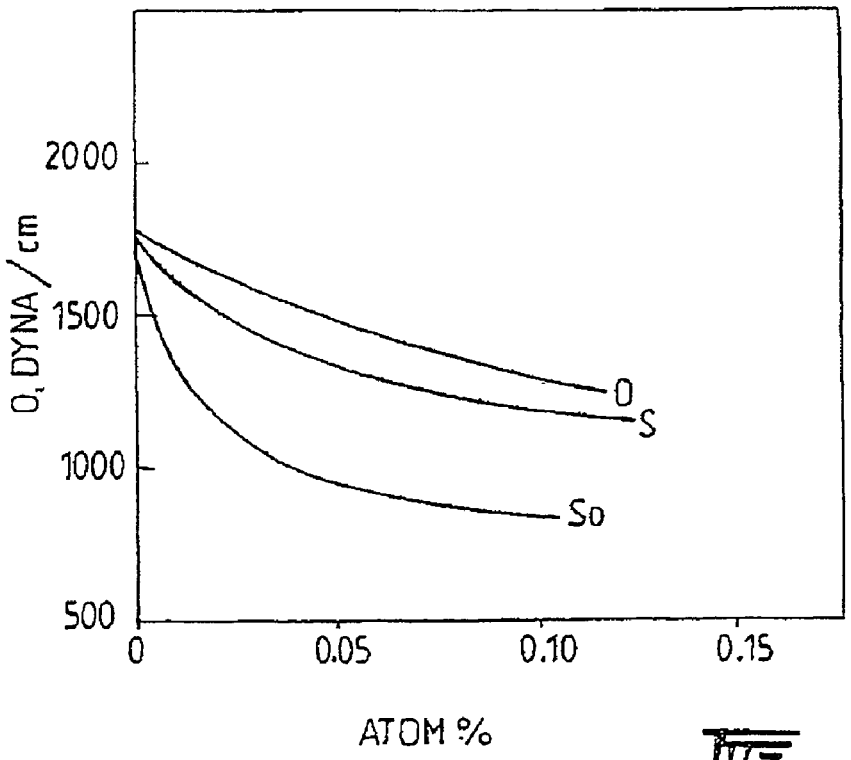
FIG. 14 shows the effect of oxygen in a molten steel on surface tension.

The free oxygen levels in Ca—Si grades were lower, typically 20 to 30 ppm compared to 40 to 50 ppm with M06 grades. Oxygen is a surface active element and thus reduction in free oxygen level is expected to reduce the wetting between molten steel and the casting rolls and cause a reduction in the heat transfer rate between the metal and the casting rolls. However, from FIG. 14 it appears that free oxygen reduction from 40 to 20 ppm may not be sufficient to increase the surface tension to levels that explain the observed reduction in the heat flux. In any case, lowering the total and free oxygen level in the steel reduces the volume of inclusions and thus reduces the number of oxide inclusions for initial nucleation. This adversely impacts the nature of the initial and continued contact between the steel shells and the roll surface.

Dip testing work has shown that a nucleation per unit area density of about $120/mm^2$ is required to generate sufficient heat flux on initial solidification in the upper or meniscus region of the casting pool. Dip testing involves advancing a chilled block into a bath of molten steel at such a speed as to closely simulate the conditions of contact at the casting surfaces of a twin roll caster. Steel solidifies onto the chilled block as it moves through the molten bath to produce a layer of solidified steel on the surface of the block. The thickness of this layer can be measured at points throughout its area to map variations in the solidification rate and in turn the effective rate of heat transfer at the various locations. Overall solidification rate as well as total heat flux measurements can therefore be determined. Changes in the solidification microstructure with the changes in observed solidification rates and heat transfer values can be correlated, and the structures associated with nucleation on initial solidification at the chilled surface examined. A dip testing apparatus is more fully described in U.S. Pat. No. 5,720,336.

The relationship of the oxygen content of the liquid steel on initial nucleation and heat transfer has been examined using a model described in Appendix 1. This model assumes that all the oxide inclusions are spherical and are uniformly distributed throughout the steel. A surface layer was assumed to be 2 μm and that only inclusions present in that surface layer could participate in the nucleation process on initial solidification of the steel. The input to the model was total oxygen content in the steel, inclusion diameter, strip thickness, casting speed, and surface layer thickness. The output was the percentage of inclusions of the total oxygen in the steel required to meet a targeted nucleation per unit area density of $120/mm^2$.

Figure 15:
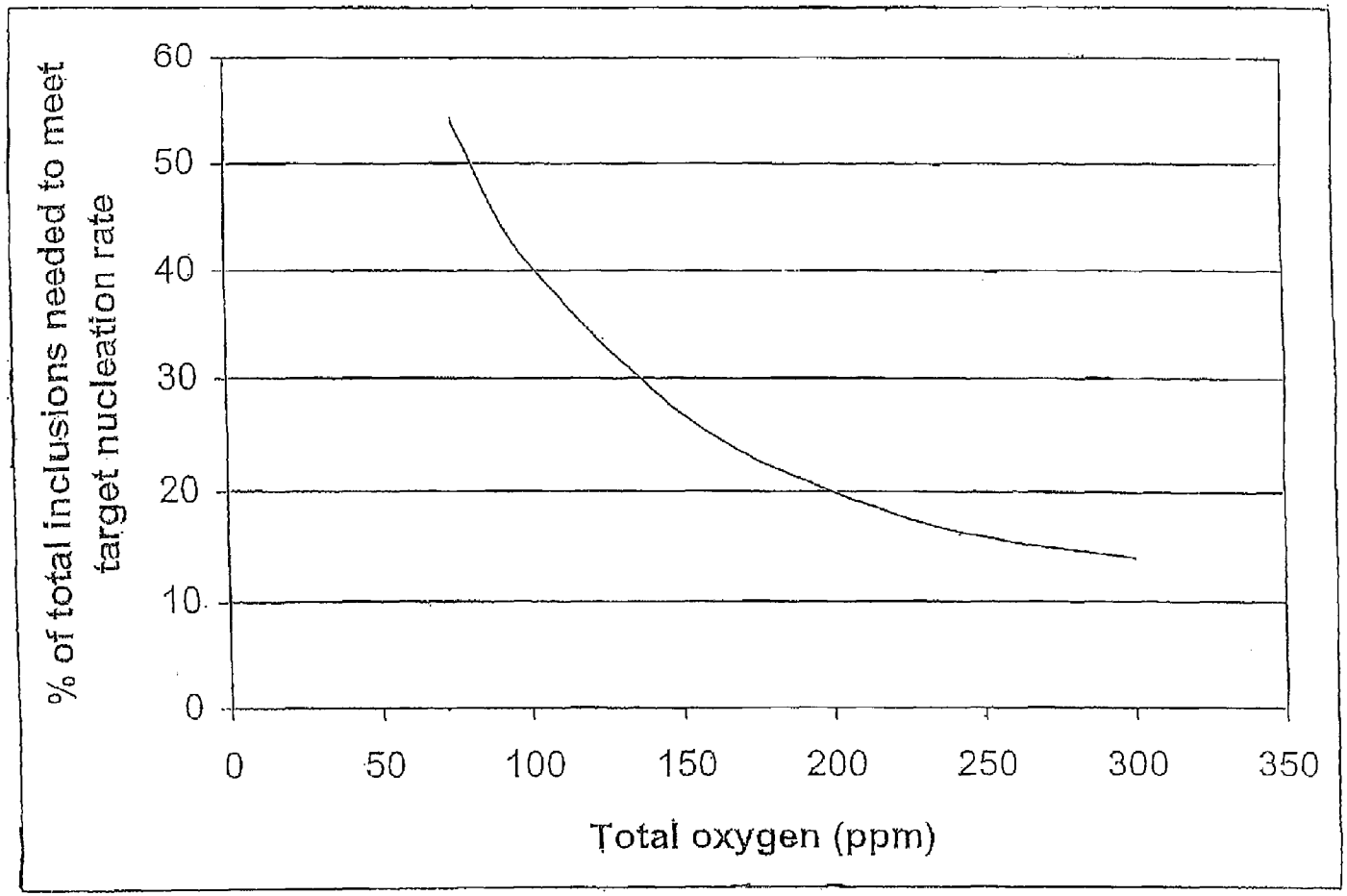
FIG. 15 is a plot of the results of calculations concerning the inclusions available for nucleation at differing steel cleanliness levels.

FIG. 15 is a plot of the percentage of oxide inclusions in the surface layer required to participate in the nucleation process to achieve the target nucleation per unit area density at different steel cleanliness levels as expressed by total oxygen content, assuming a strip thickness of 1.6 mm and a casting speed of 80 m/min. This shows that for a 2 μm inclusion size and 200 ppm total oxygen content, 20% of the total available oxide inclusions in the surface layer are required to achieve the target nucleation per unit area density of 120/mm$^2$. However, at 80 ppm total oxygen content, around 50% of the inclusions are required to achieve the critical nucleation rate and at 40 ppm total oxygen level there will be an insufficient level of oxide inclusions to meet the target nucleation per unit area density. Accordingly, the oxygen content of the steel needs to be controlled to produce a total oxygen content of at least 100 ppm and preferably below 250 ppm, typically about 200 ppm. The result is that the two micron deep layers adjacent the casting rolls on initial solidification will contain oxide inclusions having a per unit area density of at least 120/mm$^2$. These inclusions will be present in the outer surface layers of the final solidified strip product and can be detected by appropriate examination, for example by energy dispersive spectroscopy (EDS).

EXAMPLE

| | | |
|---|---|---|
| INPUTS | | |
| Critical nucleation per unit area density no/mm2 (needed to achieve sufficient heat transfer rates). | 120 | This value has been obtained from experimental dip testing work. |
| Roll width m | 1 | |
| Strip Thickness m m | 1.6 | |
| Ladle tonnes t | 120 | |
| Steel density, kg/m$^3$ | 7800 | |
| Total oxygen, ppm | 75 | |
| Inclusion density, kg/m$^3$ | 3000 | |
| OUTPUTS | | |
| Mass of inclusions, kg | 21.42857 | |
| Inclusion diameter, m | 2.00E−06 | |
| Inclusion volume, m$^3$ | 0.0 | |
| Total no of inclusions | 1706096451319381.5 | |
| Thickness of surface layer, μm (one side) | 2 | |
| Total no of inclusions surface only | 4265241128298.4536 | These inclusions can participate in the initial nucleation process. |
| Casting speed, m/min | 80 | |
| Strip length, m | 9615.38462 | |
| Strip surface area, m$^2$ | 19230.76923 | |
| Total no of nucleating sites required | 2307692.30760 | |
| % of available inclusion that need to participate in the nucleation process | 54.10462 | |

In silicon manganese killed low carbon steel strip, we have further determined that the presence of $Al_2O_3$ in the deoxidation inclusions can be highly beneficial in ensuring that those inclusions remain molten until the surrounding steel melt has solidified. With manganese/silicon killed steel, the inclusion melting point is very sensitive to changes in the ratio of manganese to silicon oxides and for some ratios the inclusion melting point may be quite high, for example greater than 1700° C., which can prevent the formation of a satisfactory liquid film on the casting surfaces, and also may lead to clogging of flow passages in the steel delivery system. The deliberate generation of $Al_2O_3$ in the deoxidation inclusions so as to produce a three phase oxide system comprising MnO, $SiO_2$ and $Al_2O_3$ can reduce the sensitivity of the melting point to changes in the $MnO/SiO_2$ ratios and can reduce the melting point.

Figure 16:
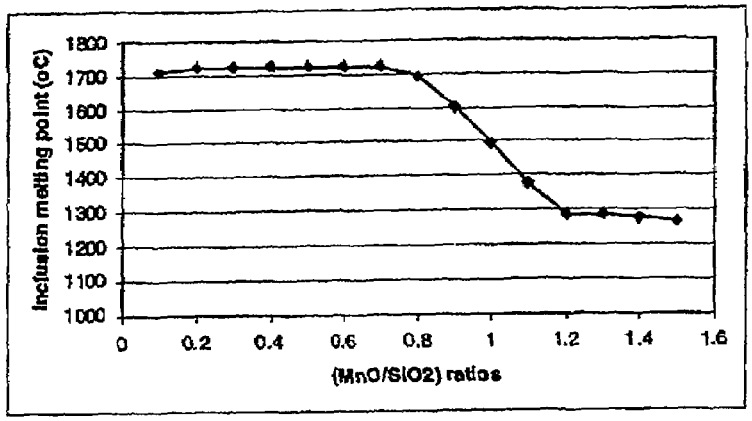
FIG. 16 illustrates the affect of $MnO/SiO_2$ ratios on inclusion melting point.

The degree to which the melting point of the deoxidation inclusions is sensitive to changes in the $Mn/SiO_2$ ratio for those inclusions is illustrated in FIG. 16 which plots variations in inclusion melting point against the relevant $MnO/SiO_2$ ratios. When casting low carbon steel strip the casting temperature is about 1580° C. It will be seen from FIG. 16 that over a certain range of $MnO/SiO_2$ ratios the inclusion melting point is much higher than this casting temperature and may be in excess of 1700° C. With such high melting points it is not possible to satisfy the requirement of ensuring the maintenance of a liquidus state in the oxide inclusions and in turn a liquid film on the casting surfaces. This steel composition is therefore not appropriate for casting. Furthermore, clogging of flow passages in the delivery nozzle and other parts of the steel delivery system can become a problem.

Although manganese and silicon levels in the steel can be adjusted with a view to producing the desired $MnO/SiO_2$ ratios, it is difficult to ensure that the desired ratios are in fact achieved in practice in a commercial plant. For example, we have determined that a steel composition having a manganese content of 0.6% and a silicon content of 0.3% is a desirable chemistry and based on equilibrium calculations should produce a $MnO/SiO_2$ ratio greater than 1.2. However, operating a commercial scale plant has shown that much lower $MnO/SiO_2$ ratios are obtained. This is shown by FIG. 17 in which $MnO/SiO_2$ ratios obtained from inclusion analysis carried out on steel samples taken at various locations in a commercial scale strip caster during casting of MO6 steel strip, the various locations being identified as follows:

| | |
|---|---|
| L1 | ladle |
| T1, T2, T3 | a tundish which receives metal from the ladle. |
| TP2, TP3 | a transition piece below the tundish. |
| S, 1, 2 | successive parts of the formed strip. |

Figure 17:
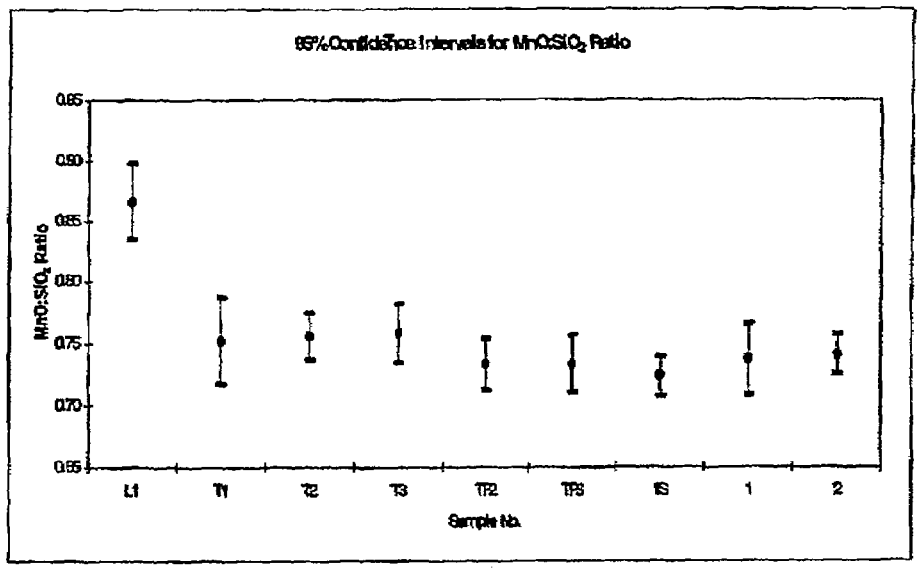
FIG. 17 illustrates $MnO/SiO_2$ ratios obtained from inclusion analysis carried out on samples taken from various locations in a strip caster during the casting of low carbon steel strip.

It will be seen from FIG. 17 that the measured $MnO/SiO_2$ ratios are all considerably lower than the calculated expected ratio of more than 1.2. Moreover, small changes in $MnO/SiO_2$ ratio, for example a reduction from 0.9 to 0.8, can increase the melting point considerably. It is further worth noting that during steel transfer operation from the ladle to the mould, steel exposure to air will cause re-oxidation which will tend to reduce the $MnO/SiO_2$ ratios (Si has more affinity for oxygen compared to Mn and thus more $SiO_2$ will be formed, so lowering the ratio). This effect can clearly be seen in FIG. 17 where the $MnO/SiO_2$ ratios in the tundish (T1, T2, T3), transition piece (TP2, TP3) and strip (S, 1, 2) are lower than in the ladle (L1).

By controlling aluminum levels, $MnO.SiO_2.Al_2O_3$ based inclusions may be controlled, and in turn, produce the following benefits:

lowers inclusion melting point particularly at lower values of $MnO/SiO_2$ ratios; and reduces the sensitivity of inclusion melting point to changes in $MnO/SiO_2$ ratios.

Figure 18:
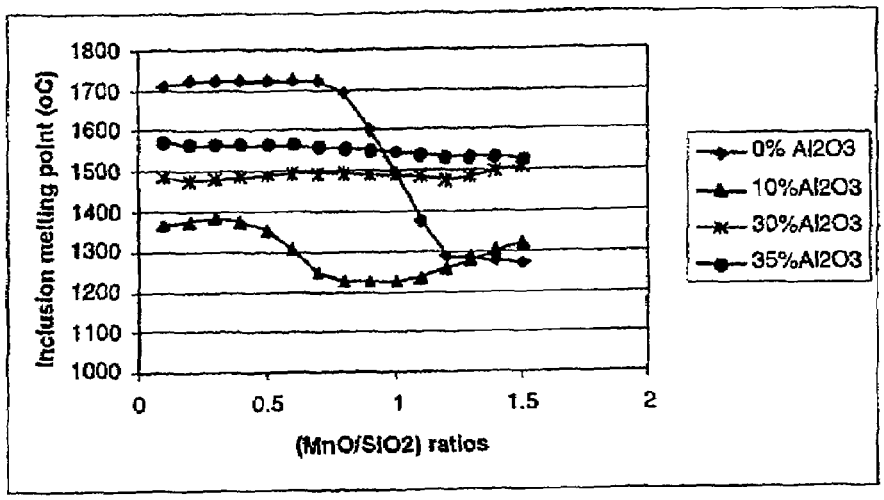
FIG. 18 illustrates the effect on inclusion melting point by the addition of $Al_2O_3$ at varying contents.
Figure 19:
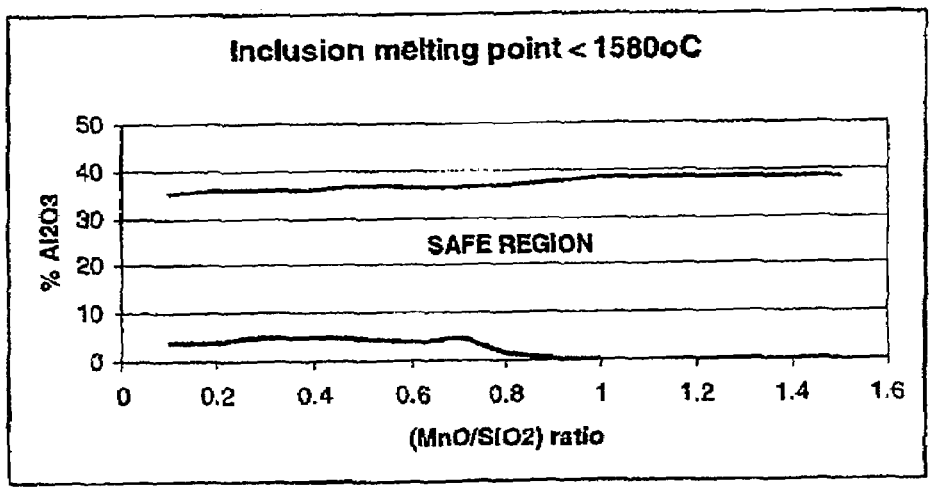
FIG. 19 illustrates how alumina levels may be adjusted within a safe operating region when casting low carbon steel in order to keep the melting point of the oxide inclusions below a casting temperature of about 1580° C.

These effects are illustrated by FIG. 18 which plots measured values of inclusion melting point for differing $MnO/SiO_2$ ratios with varying $Al_2O_3$ content. These results show that low carbon steel of varying $MnO/SiO_2$ ratios can be made castable with proper control of $Al_2O_3$ levels. FIG. 19 also shows the range of $Al_2O_3$ contents for varying $MnO/SiO_2$ ratios which will ensure an inclusion melting point of less than 1580° C. which is a typical casting temperature for a silicon manganese killed low carbon steel. It will be seen that the upper limit of $Al_2O_3$ content ranges from about 35% for an $MnO/SiO_2$ ratio of 0.2 to about 39% for an $MnO/SiO_2$ ratio of 1.6. The increase of this maximum is approximately linear and the upper limit or maximum $Al_2O_3$ content can therefore be expressed as $35+2.9\ (R-0.2)$, where R is $MnO/SiO_2$ ratio.

For $MnO/SiO_2$ ratios of less than about 0.9 it is essential to include $Al_2O_3$ to ensure an inclusion melting point less than 1580° C. An absolute minimum of about 3% is essential and a safe minimum would be of the order of 10%. For $MnO/SiO_2$ ratios above 0.9, it may be theoretically possible to operate with negligible $Al_2O_3$ content. However, as previously explained, the $MnO/SiO_2$ ratios actually obtained in a commercial plant can vary from the theoretical or calculated expected values and can change at various locations through the strip caster. Moreover the melting point can be very sensitive to minor changes in this ratio. Accordingly it is desirable to control the alumina level to produce an $Al_2O_3$ content of at least 3% for all silicon manganese killed low carbon steels.

Figure 20:
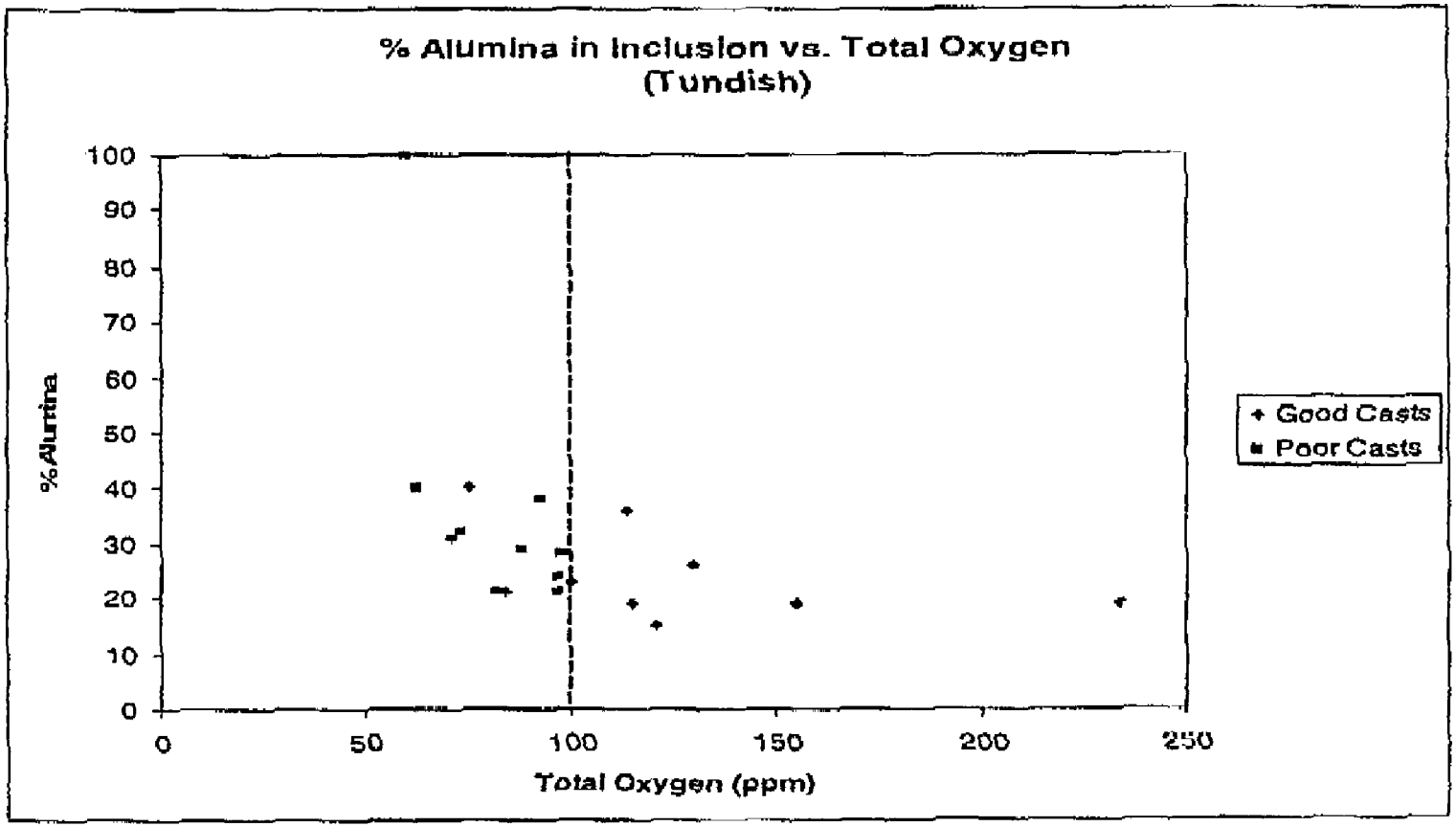
FIG. 20 illustrates results of casting with steels of varying total oxygen and $Al_2O_3$ content.

The combined effect of controlling the alumina level and the total oxygen in the melt is shown in FIG. 20 which gives the results of a large number of casts at differing $Al_2O_3$ levels and total oxygen values measured at the tundish which supplies the casting pool. The casts were rated as "Good Casts" or "Poor Casts" on the basis of both castability and measured heat flux. It will be see that over the preferred range of alumina contents, good casts could be achieved if the total oxygen was 100 ppm or greater and the free oxygen between 30 and 50 ppm.

Following the casting trials, more extensive production was commenced for which the total oxygen and free oxygen levels are reported in FIGS. 29-38. We found that the total oxygen of the of the molten steel content had to maintained above about 70 ppm and the free oxygen content expanded to 20 to 60 ppm. This was reported in FIGS. 29 through 36 for sequence runs done between Aug. 3, 2003 and Oct. 2, 2003.

Figure 29:
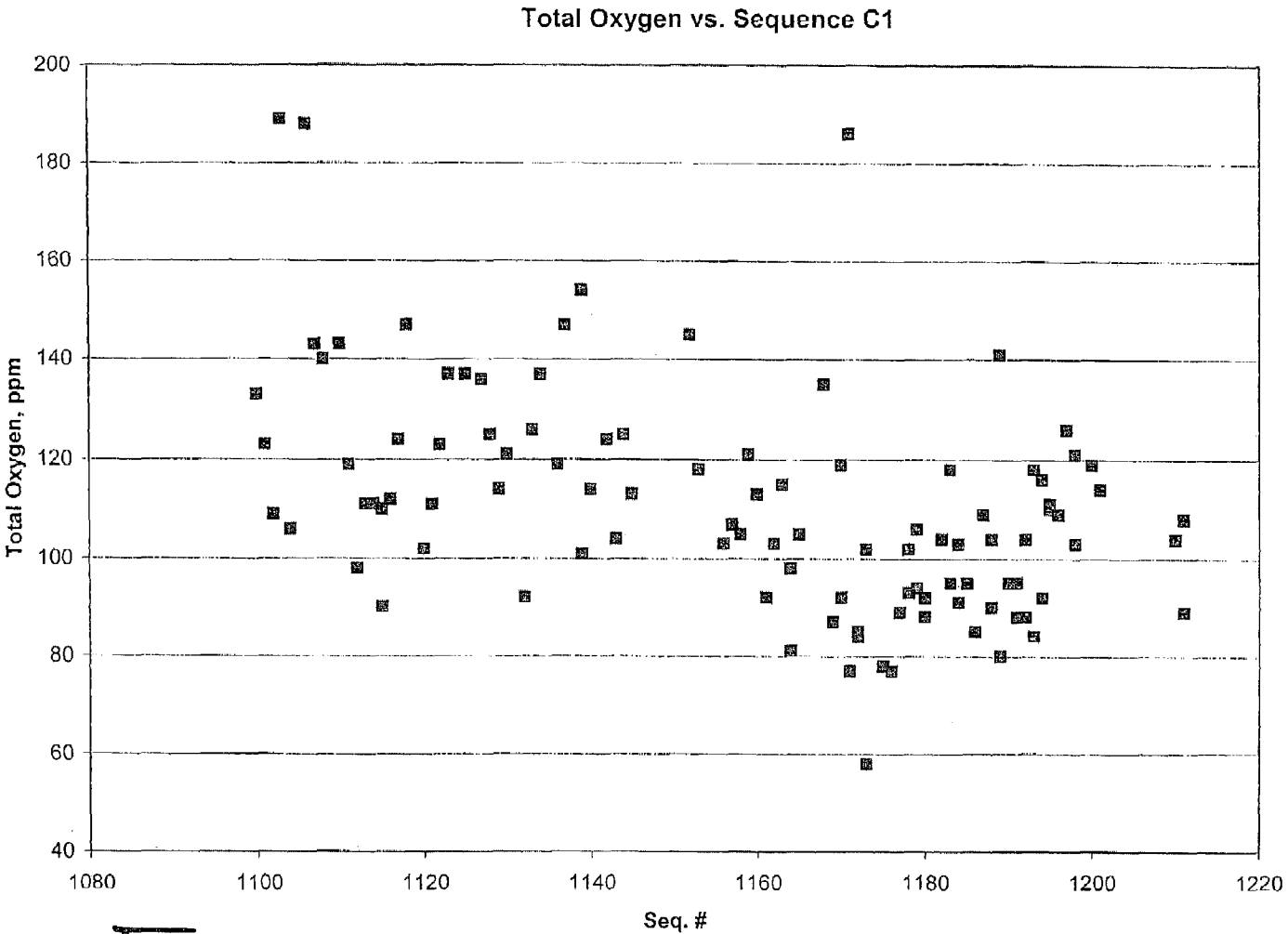
FIGS. 29 through 33 are plots showing the total oxygen content of production steel melts in the tundish immediately above the casting pool of molten steel during casting of thin strip with a twin-roll caster.
Figure 30:
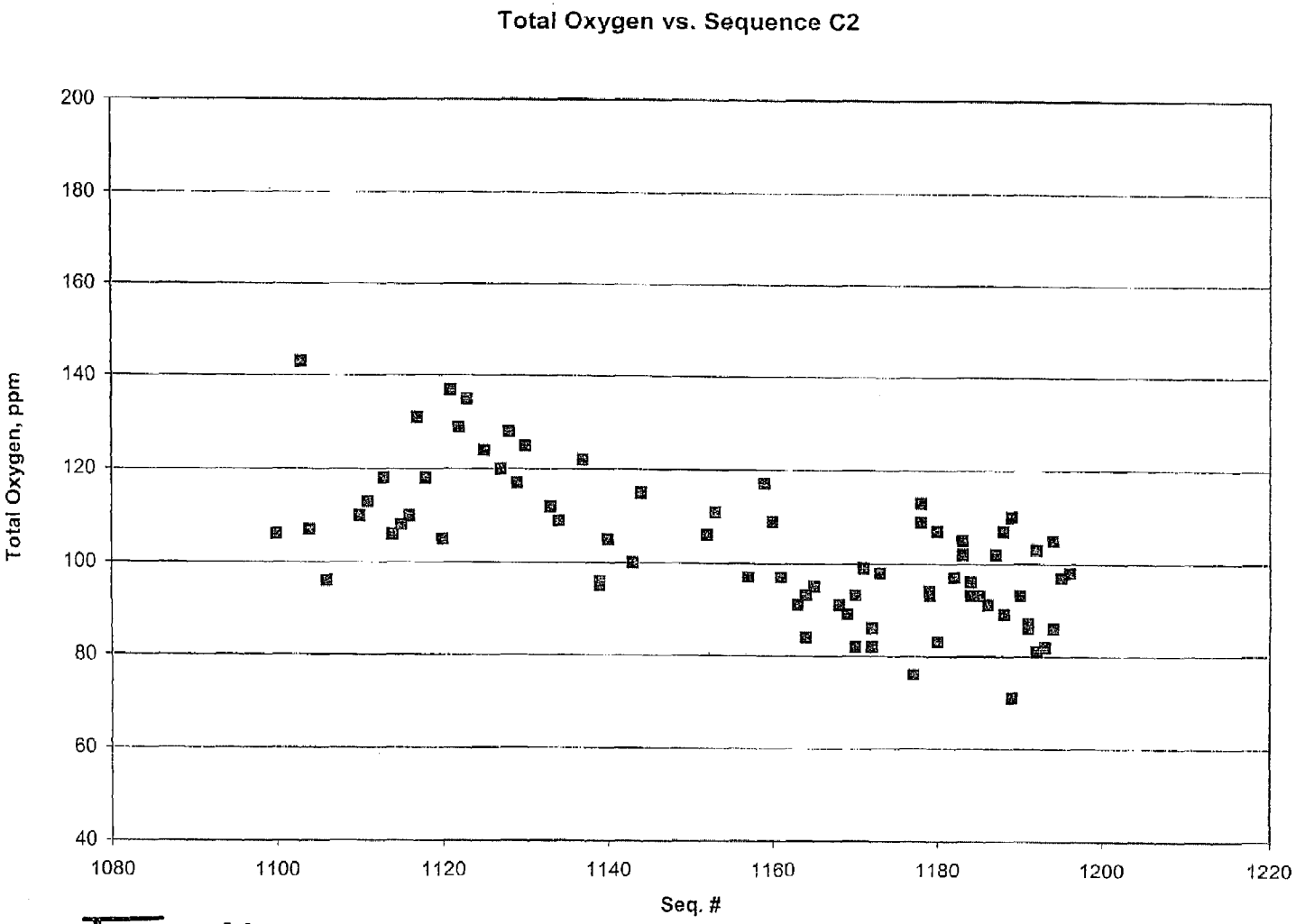
Figure 31:
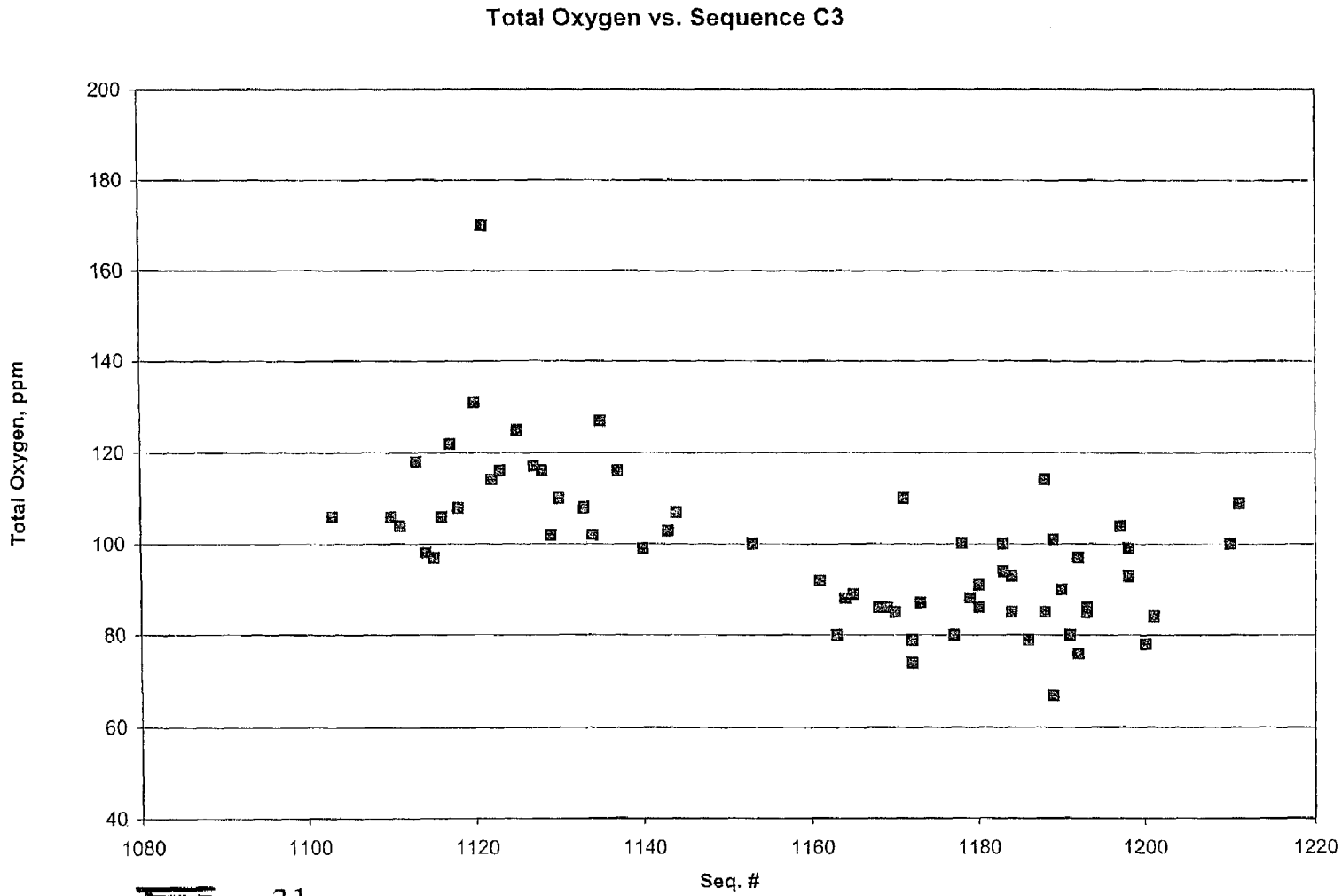
Figure 32:
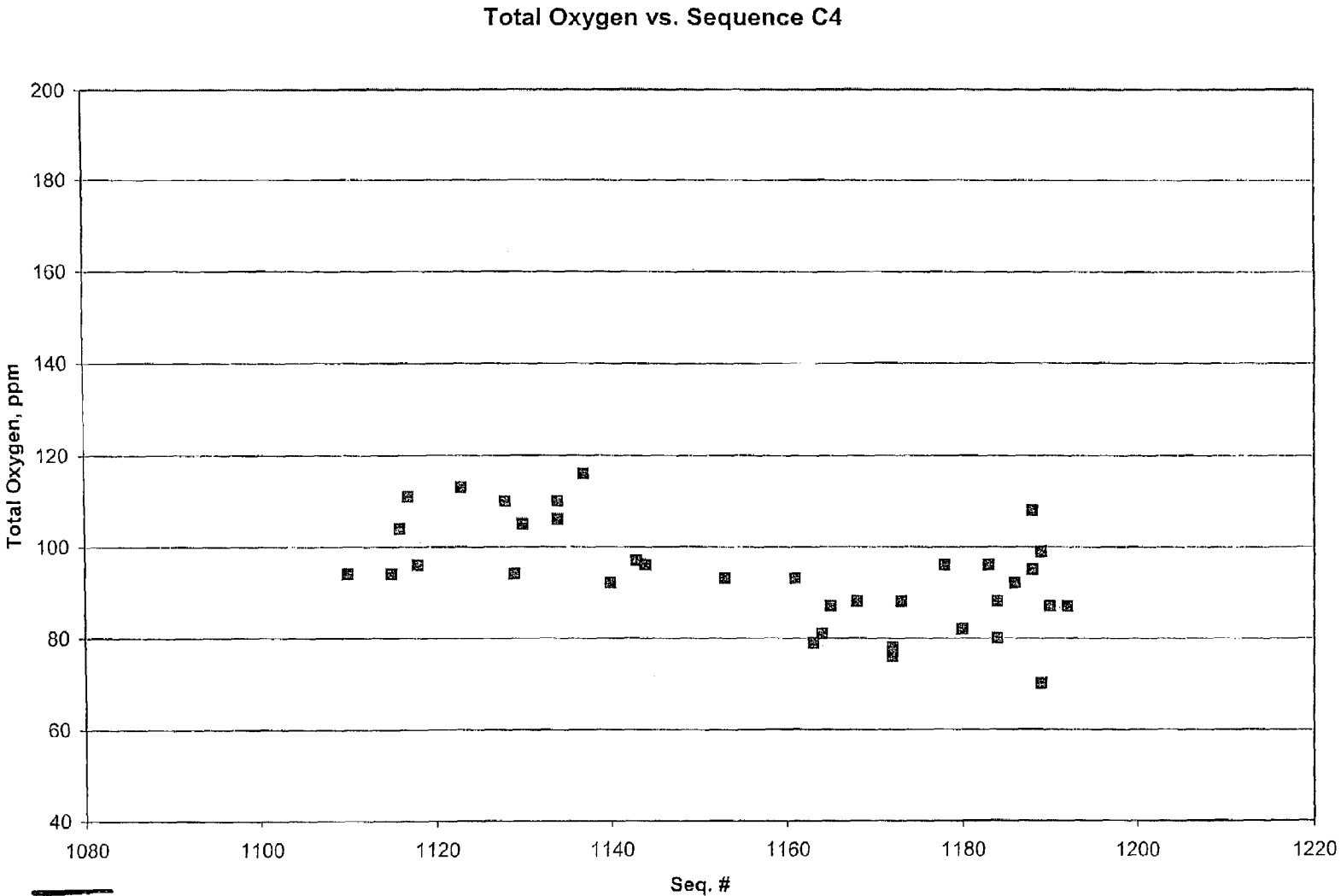
Figure 33:
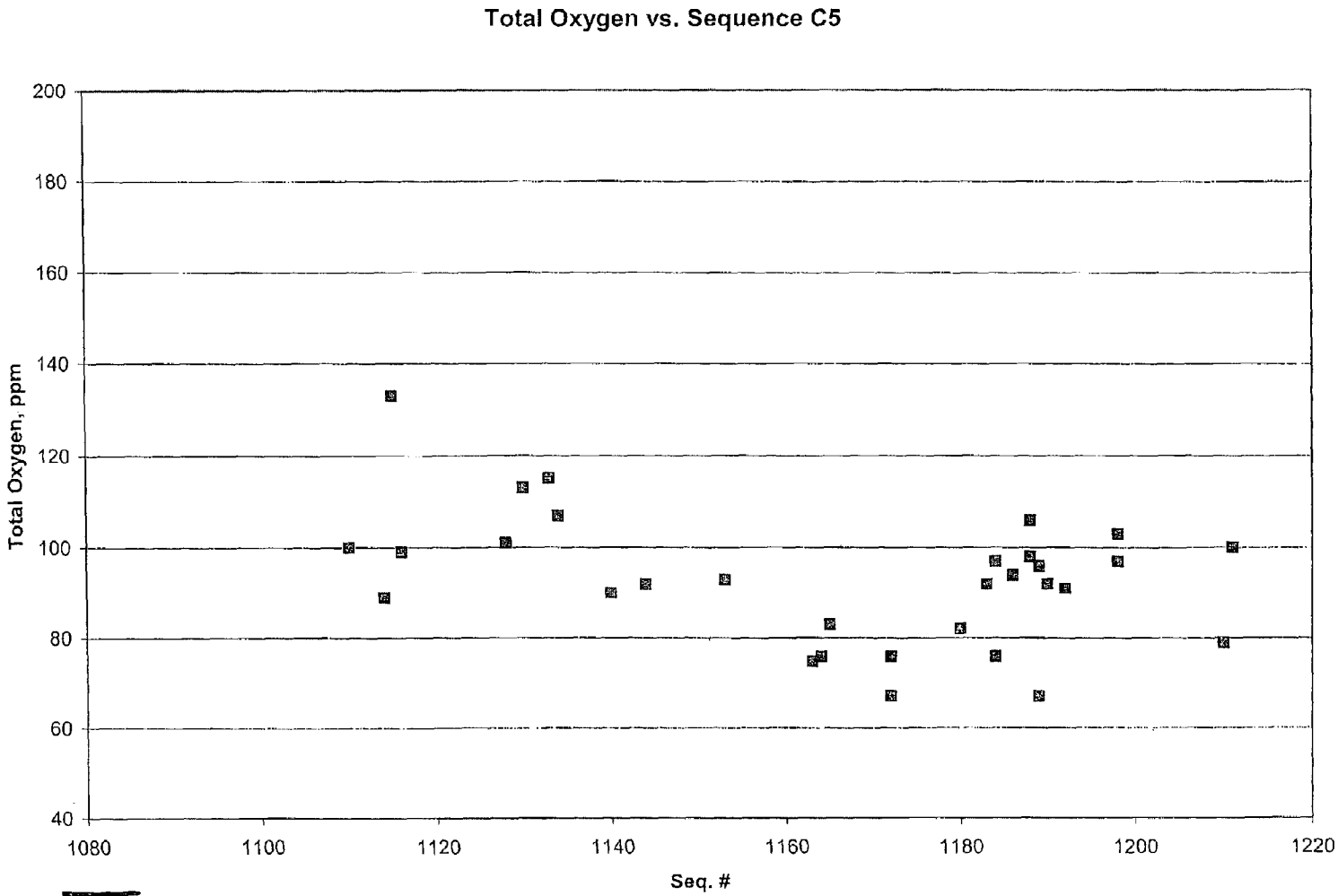
Figure 34:
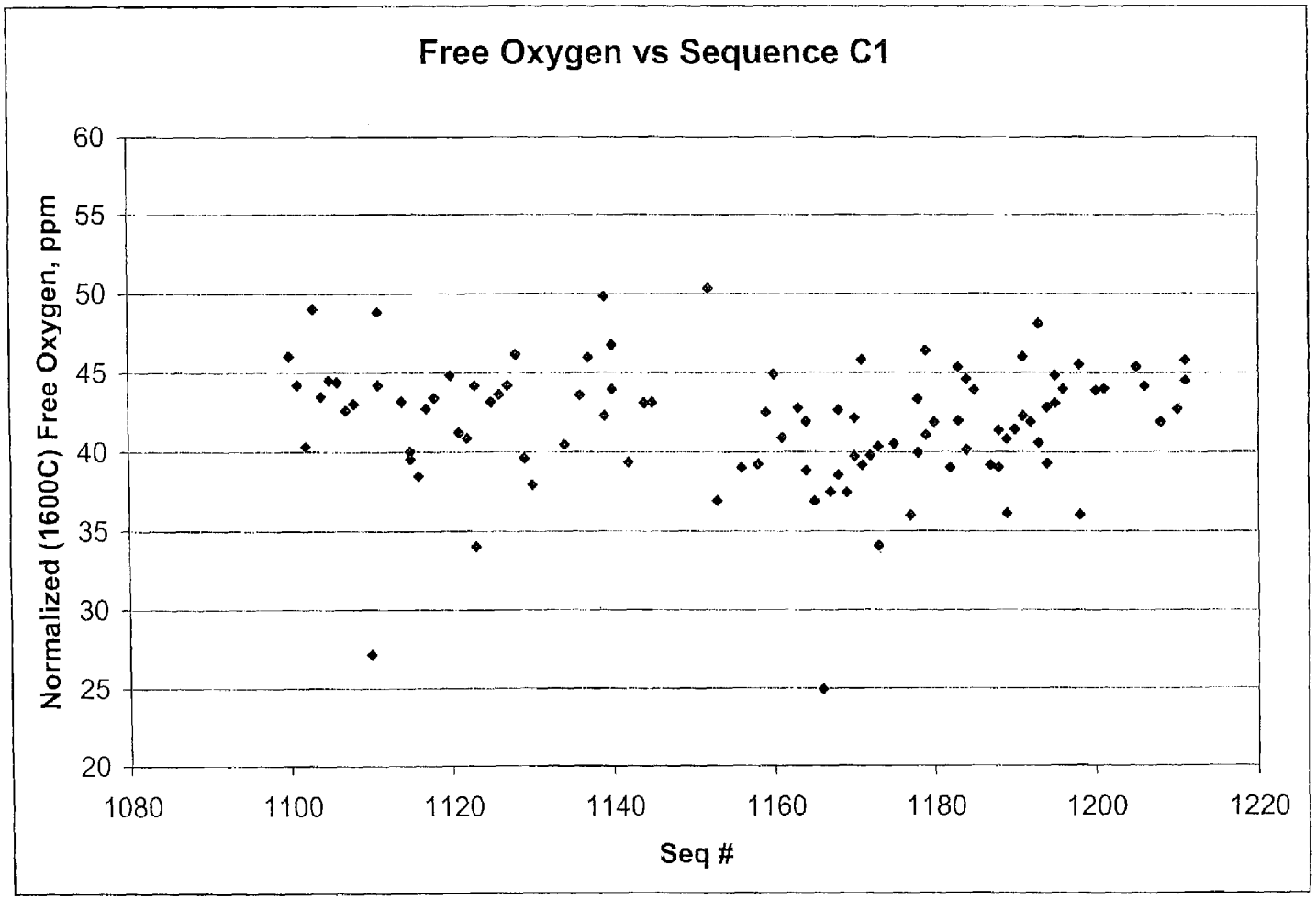
FIGS. 34 through 38 are plots of the free oxygen content of the same steel melts reported in FIGS. 29 through 33 in the tundish immediately above the casting pool of molten steel during casting of thin strip with a twin-roll caster.
Figure 35:
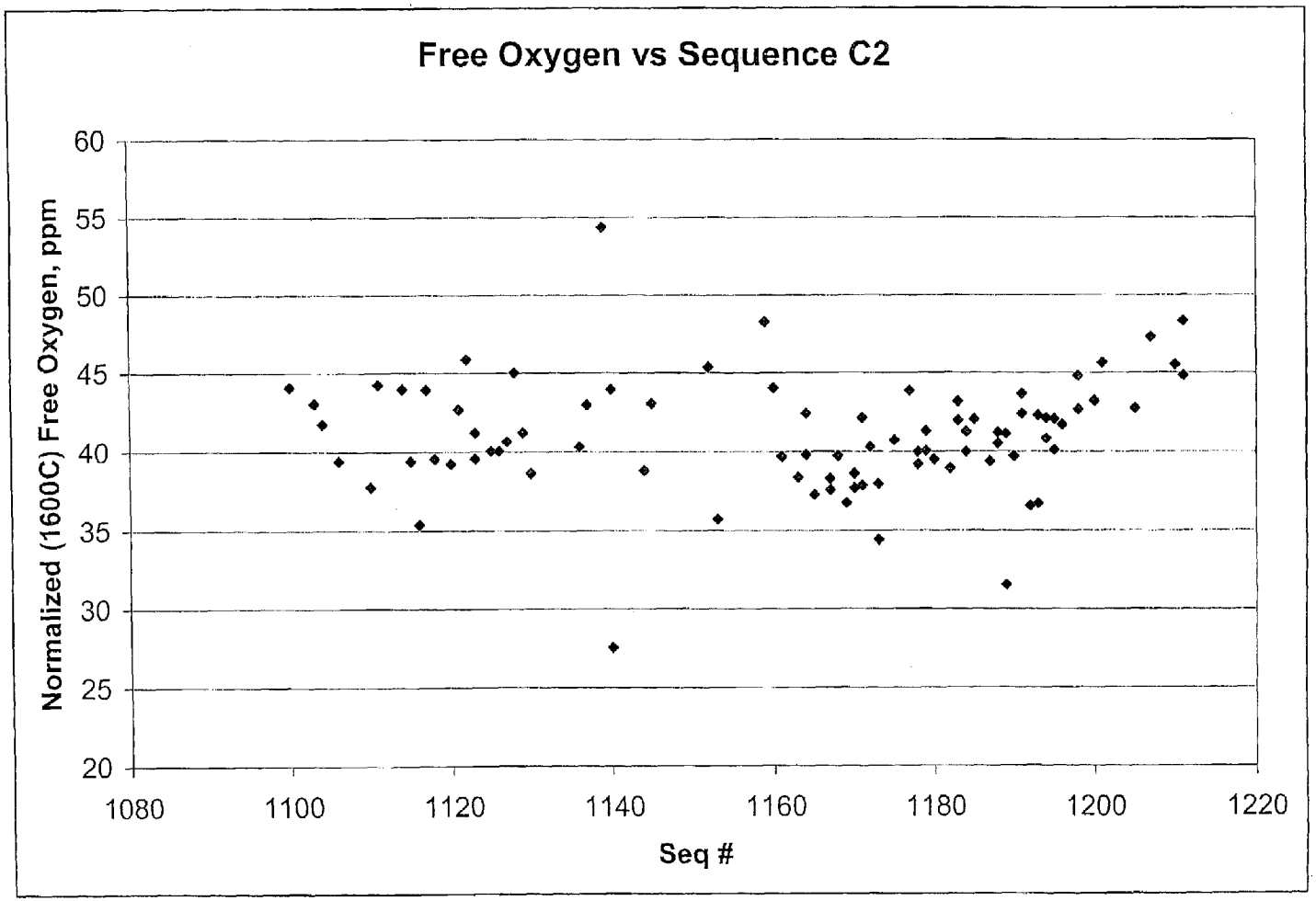
Figure 36:
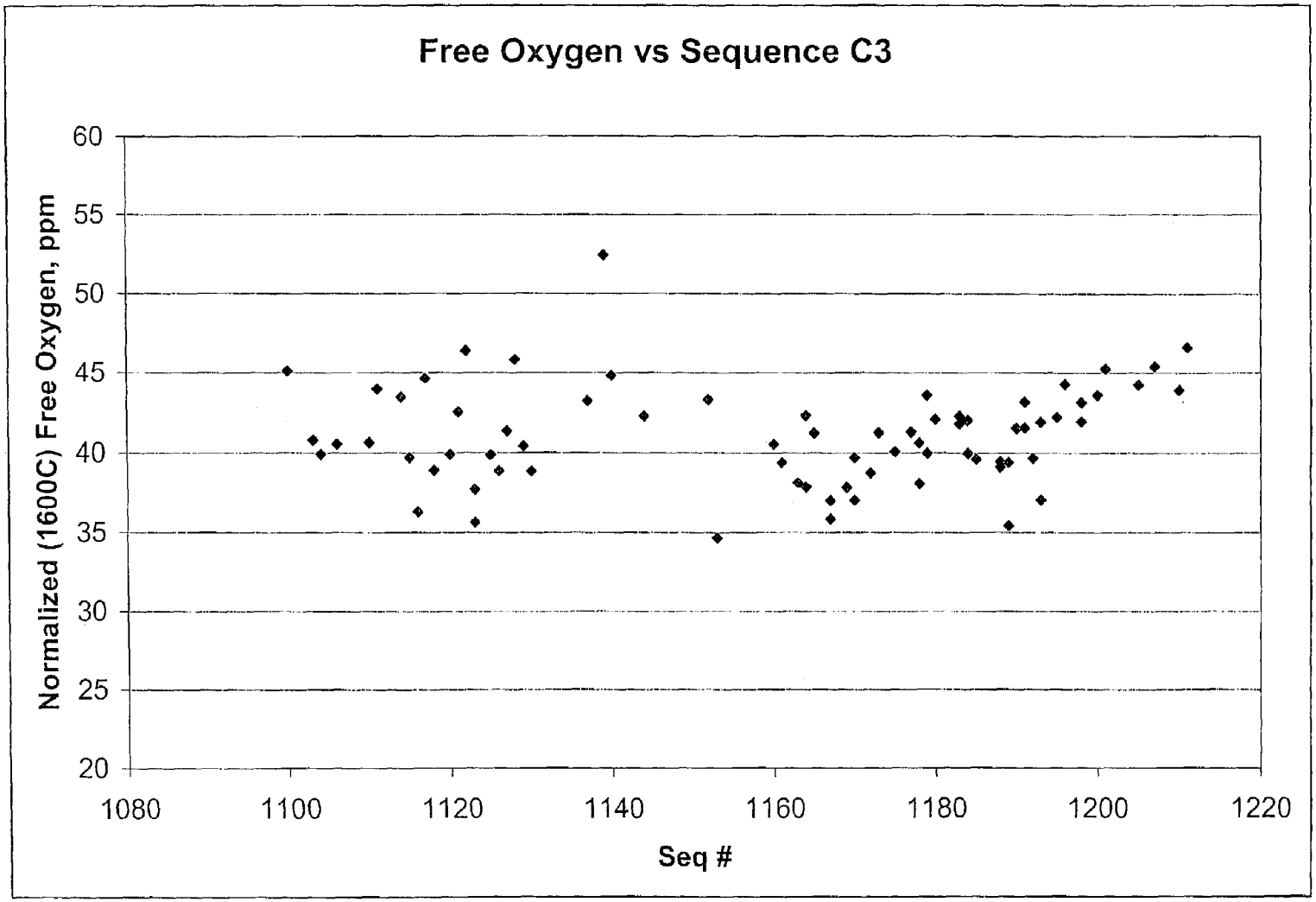
Figure 37:
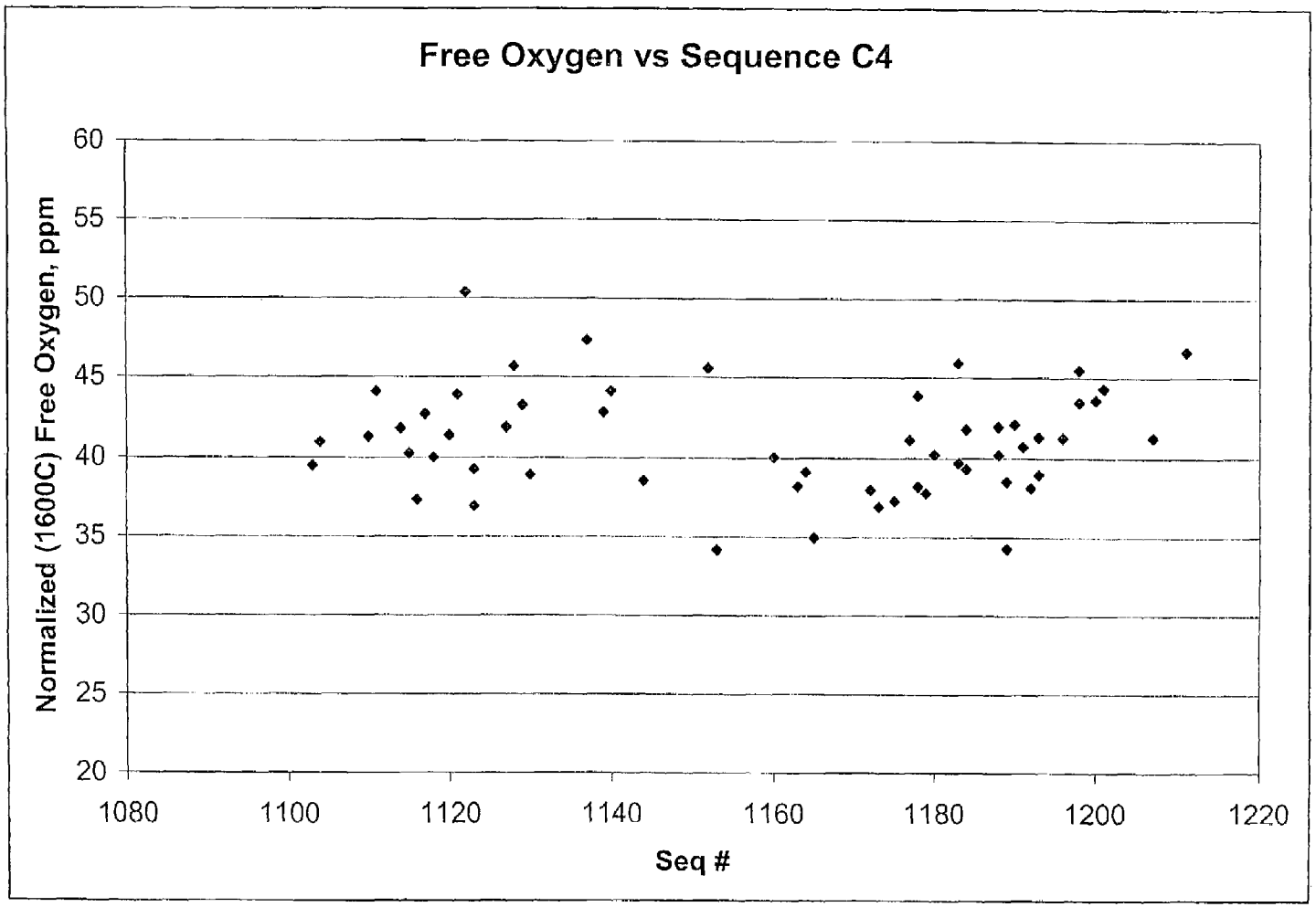
Figure 38:
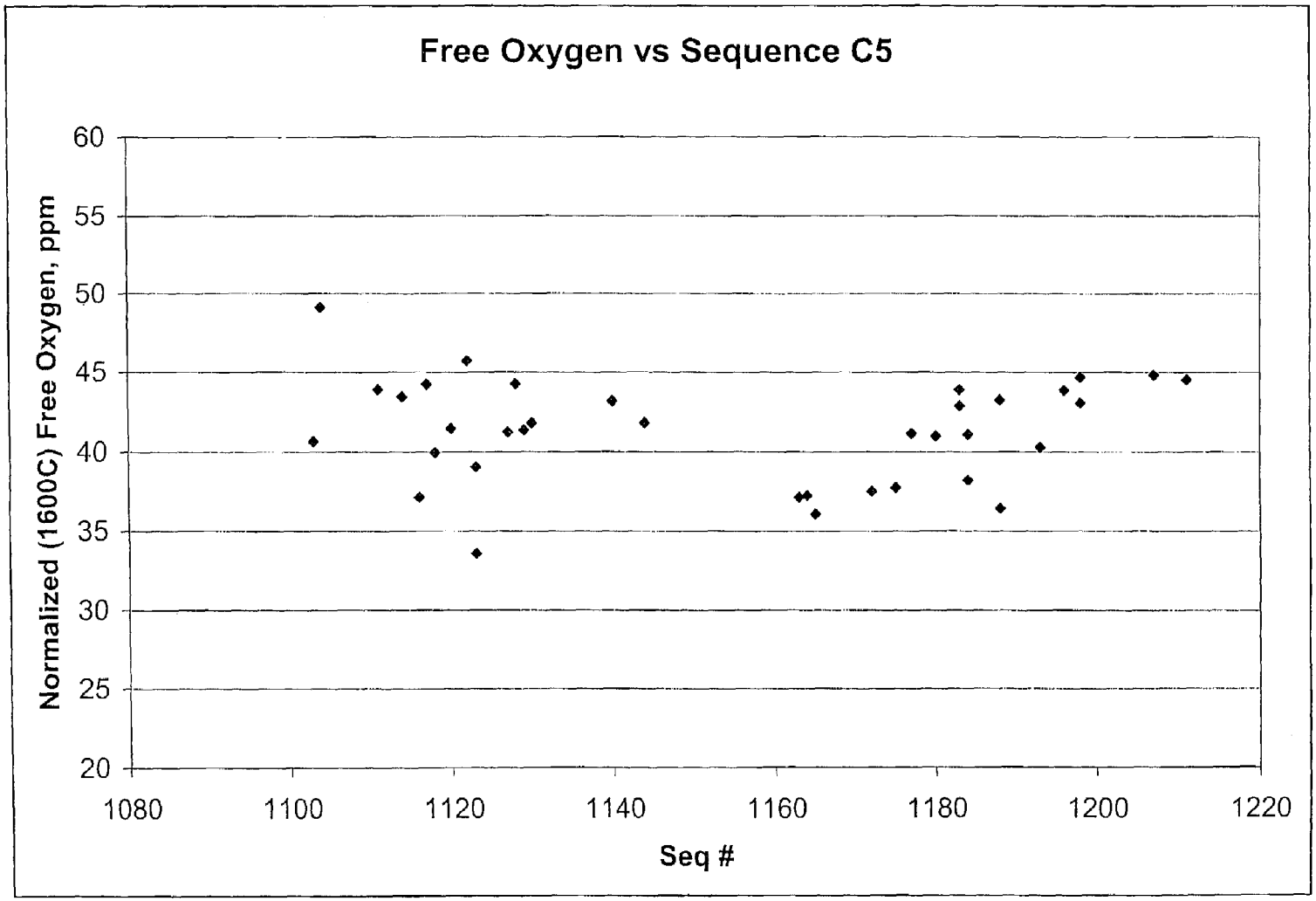

The measurements reported in FIG. 29 and 34 were the first sample taken of total oxygen and free oxygen in the tundish immediately above the casting pool. Again, the total oxygen content was measured by the LECO instrument described above, and the free oxygen content measured by the Celox® Measurement System described above. The free oxygen levels reported in FIG. 34 are the actual measured values normalized values to 1600° C., the latter value being a standardized value for measurement of free oxygen in accordance with the claims.

These free oxygen and total oxygen levels were measured in the tundish immediately above the casting pool, and although the temperature of the steel in the tundish is higher than in the casting pool, these levels are indicative of the slightly lower total oxygen and free oxygen levels of the molten steel in the casting pool. The measured values of total oxygen and free oxygen levels from the first sample are reported in FIGS. 29 and 34, taken during filling of the casting pool or immediately following filling of the casting pool at the start of the campaigns. It is understood that the total oxygen and free oxygen levels were reduced during the campaign. FIGS. 30-33 and 35-38 show the measurement of total oxygen and free oxygen in the tundish immediately above the casting pool with samples 2, 3, 4 and 5 taken during the campaign to illustrate the reduction.

Also, these data show the practice of the invention with high blow (120-180 ppm), low blow (70-90 ppm) and ultra-low blow (60-70 ppm) with the oxygen lance in the LMF. Sequence nos. from 1090 to 1130 were done with high blow practice, sequence nos. from 1130 to 1160 were done with low blow practice, and sequence nos. 1160 to 1120 were done with ultra low blow practice. These data show that the total oxygen levels reduced with the lower the blow practice, but the free oxygen levels did not reduce as much. These data show that the best procedure is to blow with ultra low blow practice to conserve oxygen used while providing adequate total oxygen and free oxygen levels to practice the invention.

As can be seen from this data, the total oxygen content is at least about 70 ppm, (except for one outlier), and typically is below 200 ppm with the total oxygen level generally between about 80 ppm and 150 ppm. The free oxygen levels are above 25 ppm and generally clustered between about 30 and about 50 ppm, which means the free oxygen content should be between 20 and 60 ppm. Higher levels of free oxygen will cause the oxygen to combine in formation of unwanted slag, and lower levels of free oxygen will result in insufficient formation of solidification inclusions for efficient shell formation and strip casting.

The solidification inclusions formed at the meniscus level of the pool on initial solidification become localized on the surface of the final strip product and can be removed by descaling or pickling. The deoxidation inclusions on the other hand are distributed generally throughout the strip. They are much coarser than the solidification inclusions and are generally in the size range 2 to 12 microns. They can readily be detected by SEM or other techniques.

Also to avoid crocodile skin roughness, we have found that the solidifying shells passing through the ferrite to austenite transition should have reached a sufficient thickness of greater than 0.30 millimeters. This shell thickness resists the stresses that are created in the shell by the volume metric change that accompanies the transition from ferrite to austenite. Given the heat flux may be on the order of 14.5 megawatts per square meter, the thickness of the shell may be about 0.32 millimeters at the start of the ferrite to austenite transition, about 0.44 millimeters at the end of that transition and about 0.78 millimeters at the nip. We have also found that it is important to the avoidance of crocodile skin roughness and improved porosity that the transition of the steel in the shell from ferrite to austenite phase occur before the shells pass through the nip of the twin roll caster.

It is also important that the oxide inclusions and nucleation be distributed relatively evenly within the steel shell. International Patent Application PCT/AU99/00641 and corresponding U.S. application Ser. No. 09/743638 discloses a method of continuously casting steel strip in which a casting pool of molten steel is supported on one or more chilled casting surfaces textured by a random pattern of discrete projections. This randomly textured casting surface is contrasted with previous proposals to employ ridged surfaced designed to promote heat transfer. The random pattern texture is less prone to crocodile skin roughness, as well as chatter defects caused by high initial heat transfer rates, the random texture having a significantly lower initial heat transfer rate than a casting surface with a ridged texture. To prevent shell distortions which cause liquid inclusions and strip porosity, we have found the initial heat transfer rate should be below 25 megawatts per square meter, and preferably of the order of 15 megawatts per square meter, which can be achieved with the random pattern texture on the casting rolls. Moreover, the random pattern texture also may contribute to an even distribution of nucleation sites over the casting surfaces which in combination with the control of oxide inclusion chemistry as described above, provides evenly spread nucleation and substantially even formation of coherent solidified shells at the outset of solidification, which is essential to the prevention of any shell distortion which can lead to liquid entrapment and strip porosity.

Figure 21:
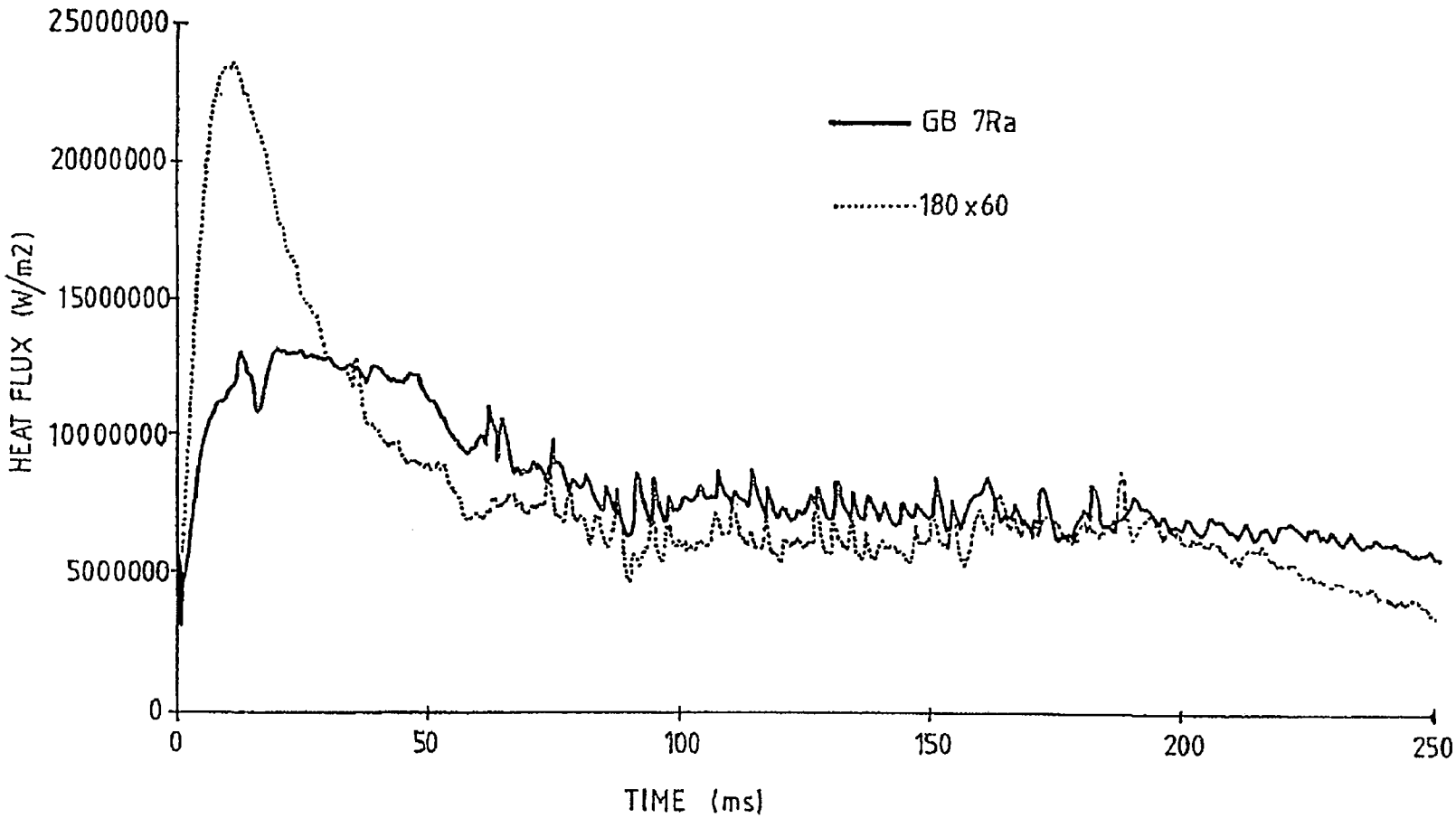
FIG. 21 indicates heat flux values obtained during solidification of steel samples on a textured substrate having a regular pattern of ridges at a pitch of 180 microns and a depth of 60 microns and compares these with values obtained during solidification onto a grit blasted substrate.

FIG. 21 plots heat flux values obtained during solidification of steel samples on two substrates, the first having a texture formed by machined ridges having a pitch of 180 microns and a depth of 60 microns and the second substrate being grit blasted to produce a random pattern of sharply peaked projections having a surface density of the order of 20 to 50 peaks per $mm^2$ and an average texture depth of about 30 microns, the substrate exhibiting an Arithmetic Mean Roughness Value of 7 Ra. It will seem that the grit blasted texture produced a much more even heat flux throughout the period of solidification. Most importantly, it did not produce the high peak of initial heat flux followed by a sharp decline as generated by the ridged texture which as explained above, is a primary cause of crocodile skin defects. The grit blasted surface or substrate produced lower initial heat flux values followed by a much more gradual decline to values which remained higher than those obtained from the ridged substrate as solidification progressed.

Figure 22:
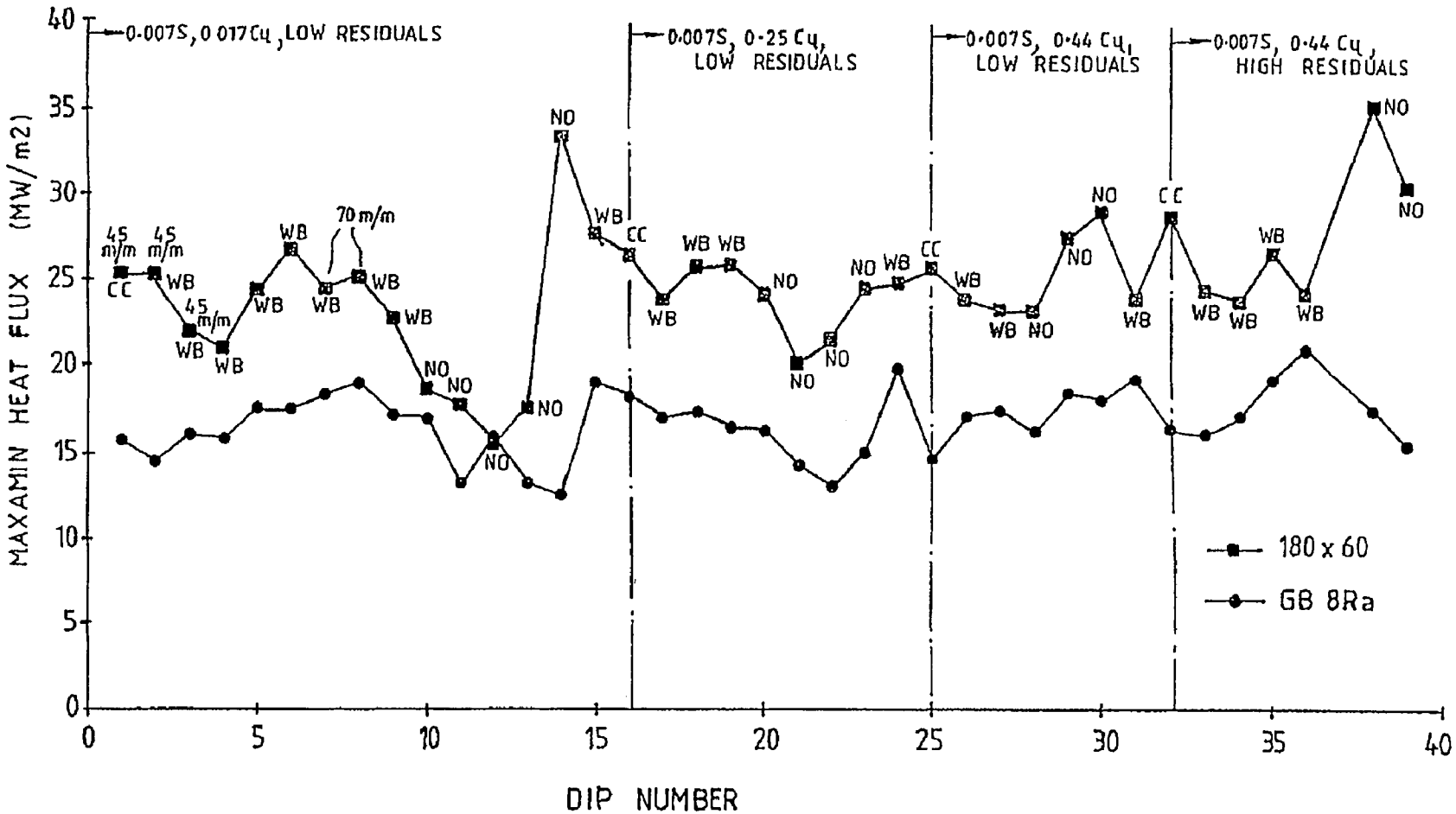
FIG. 22 plots maximum heat flux measurements obtained during successive dip tests in which steel was solidified from four different melts onto ridged and grit blasted substrates.
Figure 23:
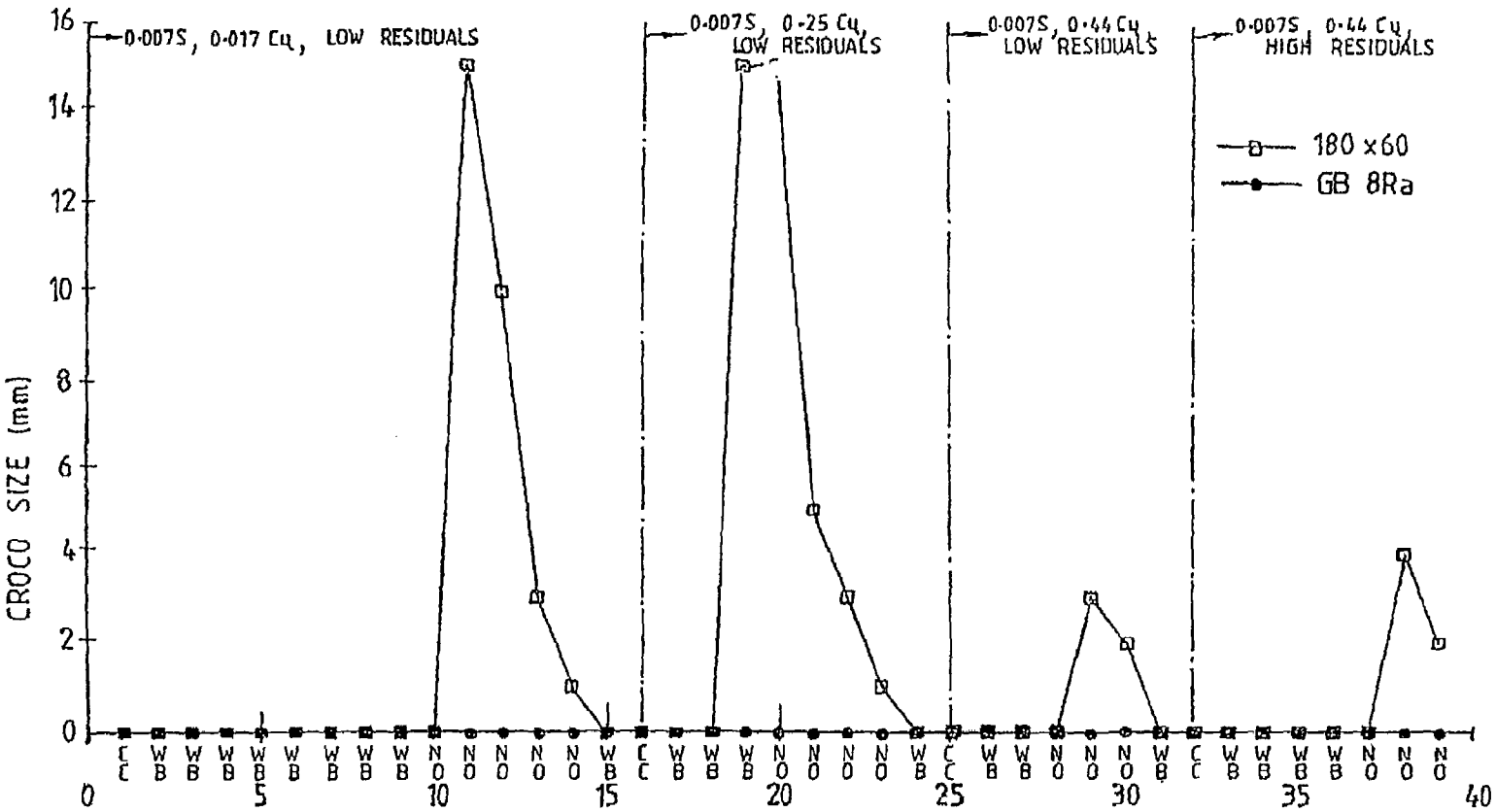
FIG. 23 indicates the results of physical measurements of crocodile-skin defects in the solidified shells obtained from the dip tests of FIG. 22.
Figure 24:
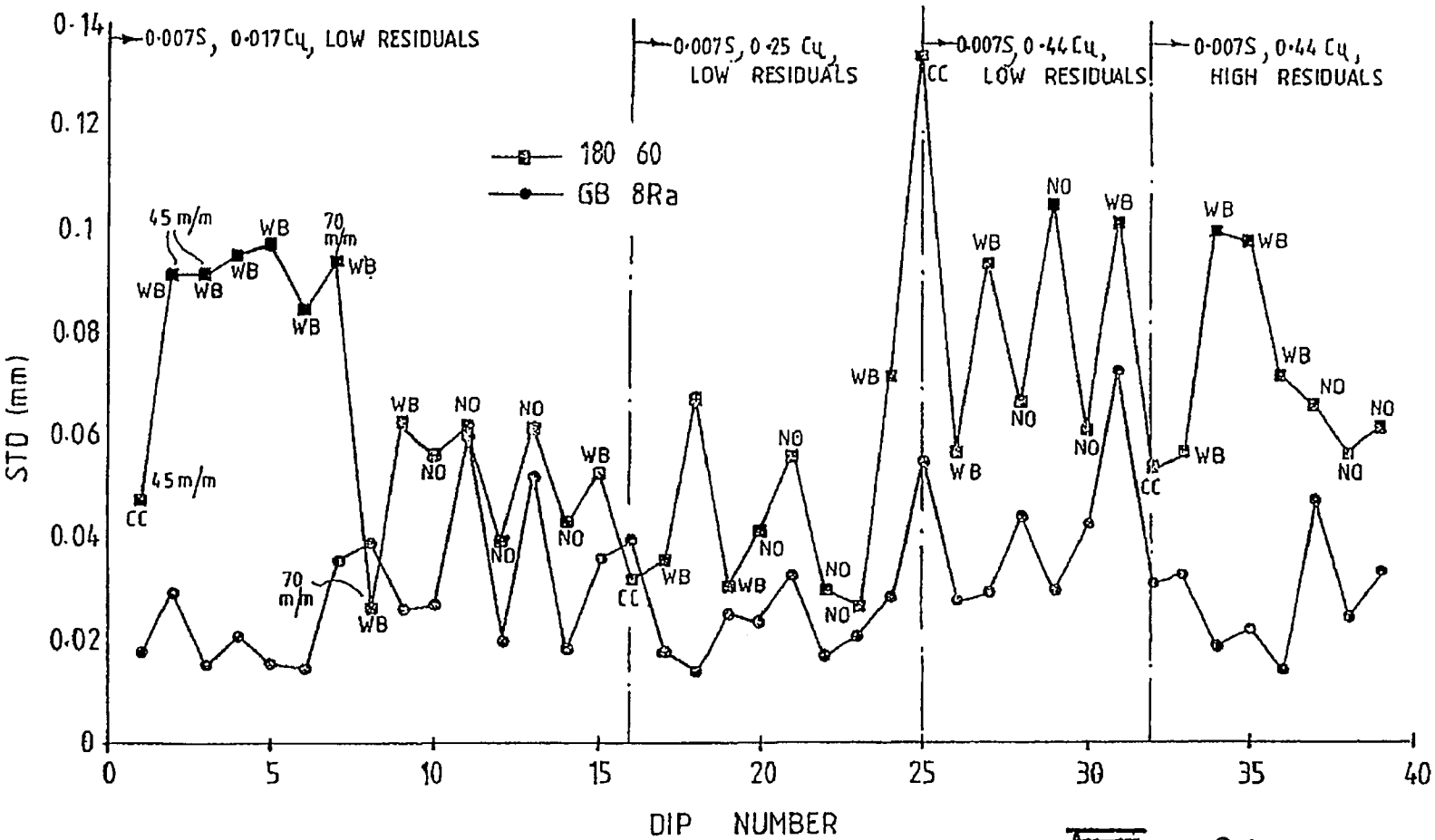
FIG. 24 indicates the results of measurements of 5 standard deviation of thickness of the solidified shells obtained in the dip tests of FIG. 22.

FIG. 22 plots maximum heat flux measurements obtained on successive dip tests using a ridged substrate having a pitch of 180 microns and a ridge depth of 60 microns and a grit blasted substrate. The test proceeded with solidification from four steel melts of differing melt chemistries. The first three melts were low residual steels of differing copper content and the fourth melt was a high residual steel melt. In the case of the ridged texture the substrate was cleaned by wire brushing for the test indicated by the letters WB but no brushing was carried out prior to some of the tests as indicated by the letters NO. No brushing was carried out prior to any of the successive tests using the grit blasted substrate. It will be seen that the grit blasted substrate produced consistently lower maximum heat flux values than the ridged substrate for all steel chemistries and without any brushing. The textured substrate produced consistently lower maximum heat flux values than the ridged substrate for all steel chemistries and without any brushing. The ridged substrate produced consistently higher heat flux values and dramatically higher values when brushing was stopped for a period, indicating a much higher sensitivity to oxide build up on the casting surface. The shells solidified in the dip test to which FIG. 22 refers were examined and crocodile skin defects measured. The results of these measurements are plotted in FIG. 23. It will be seen that the shells deposited on the ridged substrate exhibited substantial crocodile defects whereas the shells deposited on the grit blasted substrate showed no crocodile defects at all. The shells were also measured for overall thickness at locations throughout their total area to derive measurements of standard deviation of thickness which are set out in FIG. 24. It will be seen that the ridged texture produced much wider fluctuations in standard deviation of thickness than the shells solidified onto the grit blasted substrate. The shells solidified onto the grit blasted substrate have a remarkably even thickness and this is consistent with our experience in casting strip in a twin roll caster fitted with rolls having grit blasted texture that it is quite possible to produce shells of such even thickness that liquid entrapment and generation of porosity can be effectively avoided.

Figure 25:
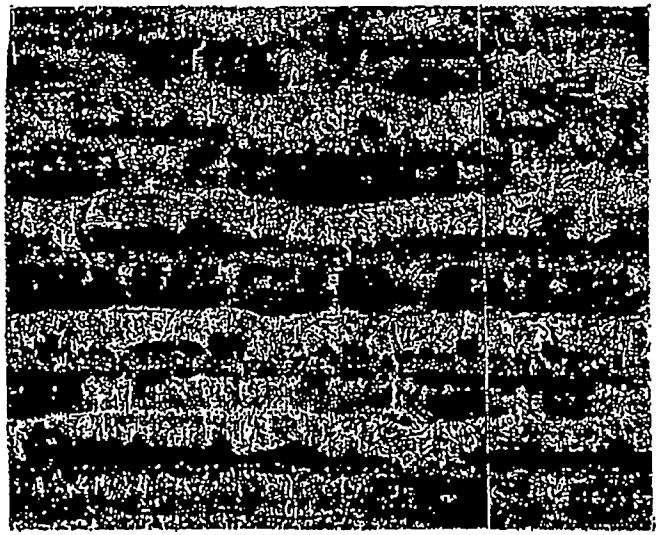
FIGS. 25 and 26 are photomicrographs of the surfaces of shells formed on ridged substrates having differing ridge depths.
Figure 26:
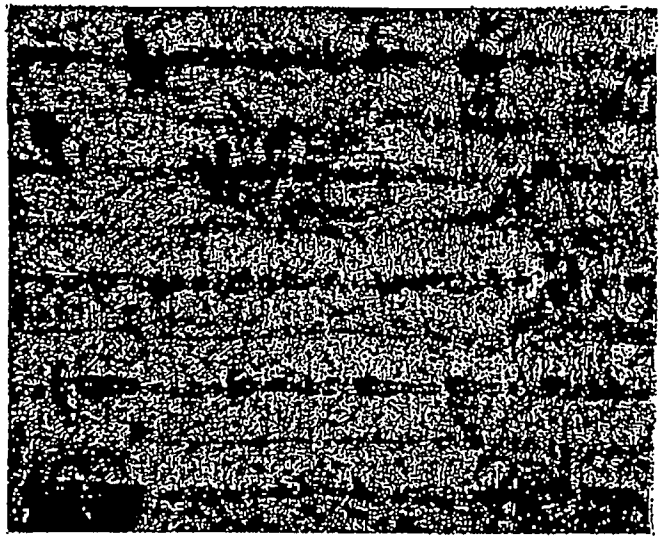
Figure 27:
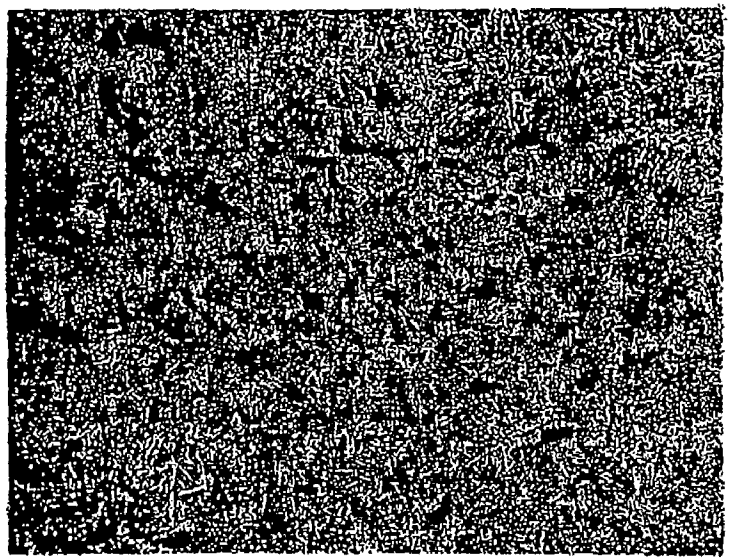
FIG. 27 is a photomicrograph of the surface of a shell solidified onto a substrate textured by a regular pattern of pyramid projections.
Figure 28:
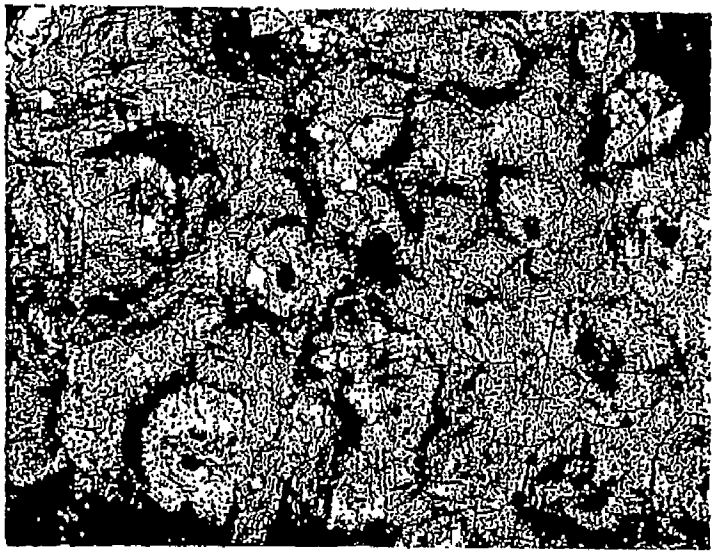
FIG. 28 is a photomicrograph of the surface of a steel shell solidified onto a grit blasted substrate.

FIGS. 25, 26, 27 and 28 are photomicrographs showing surface nucleation of shells solidified onto four different substrates having textures provided respectively by regular ridges of 180 micron pitch by 20 micron depth (FIG. 25); regular ridges of 180 micron pitch by 60 micron depth (FIG. 26); regular pyramid projections of 160 micron spacing and 20 micron height (FIG. 27) and a grit blasted substrate having a Arithmetic Mean Roughness Value of 10 Ra (FIG. 28). FIGS. 25 and 26 show extensive nucleation band areas corresponding to the texture ridges over which liquid oxides spread during initial solidification. FIGS. 27 and 28 show that the oxide coverage for the grit blasted substrate was much the same as for a regular grid pattern of pyramid projections of 20 micron height and 160 micron spacing. Thus it can be seen that the random pattern of discrete projections produced by grit blasting limits the spread of oxides and ensures an even spread of discrete oxide deposits which can serve as nucleation sites to promote establishment of a coherent shell at the outset of nucleation which in combination with controlled growth rate of the shell enables the growth of shells of remarkably even thickness as necessary to avoid liquid entrapment and strip porosity.

An appropriate random texture can be imparted to a metal substrate by grit blasting with hard particulate materials such as alumina, silica, or silicon carbide having a particle size of the order of 0.7 to 1.4 mm. For example, a copper roll surface may be grit blasted in this way to impose an appropriate texture and the textured surface projected with a thin chrome coating of the order of 50 microns thickness. Alternatively, it would be possible to apply a textured surface directly to a nickel substrate with no additional protective coating. It is also possible to achieve an appropriate random texture by forming a coating by chemical deposition or electrodeposition.

However, the random pattern in the texture of the substrate of the casting rolls to provide for distribution of the nucleation sites over the casting surface does not directly relate to the number of nucleation sites. As previously explained, at least 120 oxide inclusions per $mm^2$ comprised of MnO, $SiO_2$ and $Al_2O_3$ may be desired. It has been found that the steel will have an oxide inclusion distribution independent of the peaks in the texture of the casting roll surface. The peaks in the casting roll surface do however facilitate the uniformity of the distribution of oxide inclusions in the steel as explained above.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

APPENDIX 1 a. List of Symbols w=roll width, m
t=strip thickness, mm
ms=steel weight in the ladle, tonne
□s=density of steel, kg/m3
□I=density of inclusions, kg/m3
Ot=total oxygen in steel, ppm
d=inclusion diameter, m
vI=volume of one inclusions, m3
mI=mass of inclusions, kg
Nt=total number of inclusions
ts=thickness of the surface layer, um
Ns=total number of inclusions present in the surface (that can participate in the nucleation process)
u=casting speed, m/min
Ls=strip length, m
As=strip surface area, m2
Nreq=total number of inclusions required to meet the target nucleation density
NCt=target nucleation per unit area density, number/mm2 (obtained from dip testing)
Nav=% of total inclusions available in the molten steel at the surface of the casting rolls for initial nucleation process.

b. Equations $$mI=(Ot\times ms\times 0.001)/0.42 \quad (1)$$

Note: for Mn—Si killed steel, 0.42 kg of oxygen is needed to produce 1 kg of inclusions with a composition of 30% MnO, 40% Si02 and 30% $Al_2O_3$.

For Al-killed steel (with Ca injection), 0.38 kg of oxygen is required to produce 1 kg of inclusions with a composition of 50% $Al_2O_3$ and 50% CaO.

$$vI=4.19\times(d/2)3 \quad (2)$$

$$Nt=mi/(\square i\times vi) \quad (3)$$

$$Ns=(2.0\ ts\times 0.001\times Nt/t) \quad (4)$$

$$Ls=(ms\times 1000)/(\square s\times w\times t/1000) \quad (5)$$

$$As=2.0\times Ls\times w \quad (6)$$

$$Nreq=As\times 106\times NCt \quad (7)$$

$$Nav\ \%=(Nreq/Ns)\times 100.0 \quad (8)$$

Eq. 1 calculates the mass of inclusions in steel.

Eq. 2 calculates the volume of one inclusion assuming they are spherical.

Eq. 3 calculates the total number of inclusions available in steel.

Eq. 4 calculates the total number of inclusions available in the surface layer (assumed to be 2 μm on each side). Note that these inclusions can only participate in the initial nucleation.

Eq. 5 and Eq. 6 used to calculate the total surface area of the strip.

Eq. 7 calculates the number of inclusions needed at the surface to meet the target nucleation rate.

Eq. 8 is used to calculate the percentage of total inclusions available at the surface which must participate in the nucleation process. Note if this number is great than 100%, then the number of inclusions at the surface is not sufficient to meet target nucleation rate.

What is claimed:

1. A method of producing thin cast strip with low surface roughness and low porosity by continuous casting comprising the steps of:

a. assembling a pair of cooled casting rolls having a nip between them and with confining closure adjacent the ends of nip;

b. introducing molten steel having a total oxygen content of at least 100 ppm and a free oxygen content between 30 and 50 ppm between the pair of casting rolls to form a casting pool between the casting rolls at a temperature such that a majority of the oxide inclusions formed therein are in liquidus state;

c. counter-rotating the casting rolls and transferring heat from the molten steel to form metal shells on the surfaces of the casting rolls such that the shells grow to include oxide inclusions relating to the total oxygen content of the molten steel and form steel strip free of crocodile surface roughness; and d. forming solidified thin steel strip through the nip between the casting rolls from said solidified shells.

2. The method of making a steel strip with low surface roughness and low porosity by continuous casting as claimed in claim 1 wherein the temperature of the casting pool is below 16000° C.

3. The method of making a steel strip with low surface roughness and low porosity by continuous casting as claimed in claim 1 comprising additional step of:

forming a textured surface on the casting surfaces of the casting rolls having a random pattern of discrete projections, having an average height of at least 20 microns and having an average surface distribution of between 5 and 200 peaks per square millimeters.

4. The method of making a steel strip with low surface roughness and low porosity by continuous casting as claimed in claim 1 wherein:

the oxide inclusions comprised of MnO, $SiO_2$ and $Al_2O_3$ are distributed through the molten steel in the casting pool with an inclusion density of between 2 and 4 grams per cubic centimeter.

5. The method of making a steel strip with low surface roughness and low porosity by continuous casting as claimed in claim 1 wherein: the molten steel in the casting pool is low carbon steel having a carbon content in the range of 0.001% to 0.1% by weight, a manganese content in the range of 0.1% to 10.0% by weight, and a silicon content in the range of 0.01% to 10% by weight.

6. The method of making a steel strip with low surface roughness and low porosity by continuous casting as claimed in claim 1 wherein:

the steel shells have such manganese, silicon and aluminum oxide inclusions as to produce steel strip having a per unit area density of at least 120 oxide inclusions per square millimeter to a depth of 2 microns.

7. A method of producing thin cast strip with low surface roughness and low porosity by continuous casting comprising the steps of: a.

assembling a pair of cooled casting rolls having a nip between them and with confining closure adjacent the ends of nip;

b. introducing molten steel having a total oxygen content of at least 70 ppm and a free oxygen content between 20 and 60 ppm between the pair of casting rolls to form a casting pool between the casting rolls at a temperature such that a majority of the oxide inclusions formed therein are in liquidus state;

c. counter-rotating the casting rolls and transferring heat from the molten steel to form metal shells on the surfaces of the casting rolls such that the shells grow to include oxide inclusions relating to the total oxygen content of the molten steel and form steel strip free of crocodile surface roughness; and d. forming solidified thin steel strip through the nip between the casting rolls from said solidified shells.

8. The method of making a steel strip with low surface roughness and low porosity by continuous casting as claimed in claim 7 wherein the temperature of the casting pool is below 1600° C.

9. The method of making a steel strip with low surface roughness and low porosity by continuous casting as claimed in claim 7 comprising additional step of:

forming a textured surface on the casting surfaces of the casting rolls having a random pattern of discrete projections, having an average height of at least 20 microns and having an average surface distribution of between 5 and 200 peaks per square millimeters.

10. The method of making a steel strip with low surface roughness and low porosity by continuous casting as claimed in claim 7 wherein:

the oxide inclusions comprised of MnO, $SiO_2$ and $Al_2O_3$ are distributed through the molten steel in the casting pool with an inclusion density of between 2 and 4 grams per cubic centimeter.

11. The method of making a steel strip with low surface roughness and low porosity by continuous casting as claimed in claim 7 wherein:

the molten steel in the casting pool is low carbon steel having a carbon content in the range of 0.001% to 0.1% by weight, a manganese content in the range of 0.1% to 10.0% by weight, and a silicon content in the range of 0.01% to 10% by weight.

12. The method of making a steel strip with low surface roughness and low porosity by continuous casting as claimed in claim 7 wherein:

the steel shells have such manganese, silicon and aluminum oxide inclusions as to produce steel strip having a per unit area density of at least 120 oxide inclusions per square millimeter to a depth of 2 microns.

13. The method of making a steel strip with low surface roughness and low porosity by continuous casting as claimed in claim 7 wherein:

the molten steel in the casting pool has an aluminum content of the order of less than 0.01%.

* * * * *

UNITED STATES PATENT AND TRADEMARK OFFICE

CERTIFICATE OF CORRECTION

PATENT NO. : 7,281,569 B2
APPLICATION NO. : 10/761947
DATED : October 16, 2007
INVENTOR(S) : Walter N. Blejde, Rama Mahapatra and Lazar Strezov It is certified that error appears in the above-identified patent and that said Letters Patent is hereby corrected as shown below:

Column 18, line 43, Claim 2, "16000" should be changed to --1600--.

Signed and Sealed this

Third Day of August, 2010

David J. Kappos

David J. Kappos
*Director of the United States Patent and Trademark Office*